US011492793B2

(12) United States Patent
Kulick, III et al.

(10) Patent No.: US 11,492,793 B2
(45) Date of Patent: Nov. 8, 2022

(54) STORM WATER DRAIN TANK AND ASSEMBLY

(71) Applicant: Brentwood Industries, Inc., Reading, PA (US)

(72) Inventors: Frank M. Kulick, III, Reading, PA (US); Brian Edwards, Reading, PA (US)

(73) Assignee: BRENTWOOD INDUSTRIES, INC., Reading, PA (US)

( * ) Notice: Subject to any disclaimer, the term of this patent is extended or adjusted under 35 U.S.C. 154(b) by 0 days.

(21) Appl. No.: 17/434,567

(22) PCT Filed: Aug. 23, 2019

(86) PCT No.: PCT/US2019/047860
§ 371 (c)(1),
(2) Date: Aug. 27, 2021

(87) PCT Pub. No.: WO2020/185252
PCT Pub. Date: Sep. 17, 2020

(65) Prior Publication Data

US 2022/0127833 A1 Apr. 28, 2022

Related U.S. Application Data

(60) Provisional application No. 62/815,639, filed on Mar. 8, 2019.

(51) Int. Cl.
*E03F 1/00* (2006.01)
*E02B 11/00* (2006.01)
*B65D 21/02* (2006.01)

(52) U.S. Cl.
CPC ..... *E03F 1/005* (2013.01); *B65D 21/0209* (2013.01); *E02B 11/00* (2013.01)

(58) Field of Classification Search
CPC ... E03F 1/00; E03F 1/002; E03F 1/005; E03F 5/04; E03F 5/0401; E03F 5/06;
(Continued)

(56) References Cited

U.S. PATENT DOCUMENTS 3,221,616 A * 12/1965 Flegel ..... E03F 5/046 49/464
6,112,894 A 9/2000 Kikuchi et al.
(Continued)

FOREIGN PATENT DOCUMENTS

CA 2776567 A1 4/2011
CN 102575445 A 7/2012
(Continued)

OTHER PUBLICATIONS

International Search Report and Written Report for PCT/US19/47860 dated Apr. 16, 2020.
(Continued)

*Primary Examiner* — Joseph W Drodge
(74) *Attorney, Agent, or Firm* — Panitch Schwarze Belisario & Nadel LLP

(57) ABSTRACT

A storm water drain tank module for assembly into a storm tank for storage of storm water includes a top platen, a bottom platen and a support spacer. The top platen has an upper surface and a top platen peripheral edge. The bottom platen has a bottom surface and a bottom platen peripheral edge. The support spacer is attached to the top and bottom platens to space the top platen relative to the bottom platen. A plurality of tabs and a plurality of slots are defined proximate the top and bottom platen peripheral edges, respectively. Each of the plurality of tabs extends outwardly away from the top and bottom platen peripheral edges, respectively, and each of the plurality of slots extends into
(Continued)

the top and bottom platen peripheral edge. The plurality of slots is open in a lateral direction.

24 Claims, 12 Drawing Sheets

(58) Field of Classification Search
CPC .... E03F 5/10; E03F 5/101; E03F 5/14; E02B 11/00; B65D 21/02; B65D 21/0201; B65D 21/0209
USPC ..... 220/4.12, 565
See application file for complete search history.

(56) References Cited

U.S. PATENT DOCUMENTS

| | | | | |
|---|---|---|---|---|
| 6,287,459 | B1 | 9/2001 | Williamson | |
| 6,779,946 | B1 | 8/2004 | Urriola et al. | |
| 7,056,058 | B2 | 6/2006 | Urriola et al. | |
| 7,264,418 | B1 * | 9/2007 | Houck | E03F 3/046 405/47 |
| 7,591,610 | B2 | 9/2009 | Krichten et al. | |
| 7,621,695 | B2 | 11/2009 | Smith et al. | |
| 7,677,835 | B2 | 3/2010 | Oscar | |
| 7,704,011 | B2 | 4/2010 | Marshall | |
| 7,815,395 | B1 | 10/2010 | Blackwood | |
| 7,833,413 | B1 | 11/2010 | Rotondo et al. | |
| 8,360,100 | B2 | 1/2013 | Burkhart, Sr. et al. | |
| 8,491,224 | B2 | 7/2013 | Cobb et al. | |
| 8,496,405 | B1 | 7/2013 | Kincheloe | |
| 8,833,708 | B2 | 9/2014 | Droomer | |
| 9,085,886 | B2 | 7/2015 | Urban et al. | |
| 9,085,887 | B2 | 7/2015 | Urban et al. | |
| 9,206,559 | B2 | 12/2015 | Bach et al. | |
| D806,272 | S | 12/2017 | Bach | |
| 10,227,766 | B1 | 3/2019 | Miller | |
| 2002/0185422 | A1 * | 12/2002 | Turner, Jr. | B01D 21/02 210/162 |
| 2004/0238424 | A1 * | 12/2004 | Thompson | E03F 5/06 210/163 |
| 2006/0159515 | A1 * | 7/2006 | Messerschimidt | E03F 5/06 405/36 |
| 2006/0231509 | A1 * | 10/2006 | Marzett | B01D 21/0006 210/791 |
| 2007/0090833 | A1 * | 4/2007 | Hachtel | G01B 7/105 324/230 |
| 2007/0181197 | A1 * | 8/2007 | Krichten | E03F 1/005 137/833 |
| 2007/0217866 | A1 * | 9/2007 | Oscar | E03F 1/005 405/36 |
| 2008/0149188 | A1 | 6/2008 | Zimmerman et al. | |
| 2008/0166182 | A1 | 7/2008 | Smith et al. | |
| 2009/0279953 | A1 | 11/2009 | Allard et al. | |
| 2010/0221068 | A1 | 9/2010 | Burkhart, Sr. et al. | |
| 2011/0097151 | A1 | 4/2011 | Lee et al. | |
| 2012/0085052 | A1 | 4/2012 | Bouchard et al. | |
| 2015/0016874 | A1 | 1/2015 | Wandkowski et al. | |
| 2017/0158432 | A1 | 6/2017 | Pearce | |
| 2017/0292259 | A1 | 10/2017 | Van Der Scheer et al. | |
| 2020/0032500 | A1 * | 1/2020 | Bhatia | E03F 1/005 |
| 2020/0056361 | A1 * | 2/2020 | Bhatia | E03F 1/005 |

FOREIGN PATENT DOCUMENTS

| | | | |
|---|---|---|---|
| CN | 102575445 | B | 3/2015 |
| DE | 20302681 | U1 | 7/2003 |
| DE | 102009044412 | A1 | 4/2011 |
| EP | 2470722 | A1 | 7/2012 |
| WO | 2011042415 | A1 | 4/2011 |

OTHER PUBLICATIONS

International Preliminary Report on Patentability for PCT/US19/47860 dated Oct. 29, 2019.

* cited by examiner

STORM WATER DRAIN TANK AND ASSEMBLY

CROSS-REFERENCE TO RELATED APPLICATIONS

The present application is a Section 371 national phase application of International Patent Application No. PCT/US2019/047860, filed Aug. 23, 2019 and titled, "Storm Water Drain Tank Modules and Assembly" and claims the benefit of U.S. Provisional Patent Application No. 62/815,639 filed on Mar. 8, 2019 and titled, "Storm Water Drain Tank Modules and Assembly" the entire contents of which are incorporated herein by reference in their entirety.

BACKGROUND OF THE INVENTION

Box structure systems or storm tanks create an underground void space for the collection of storm water. Once directed into the system, the water may be released into the surrounding soil, piped elsewhere, or stored. In order to maintain this void space, the system must resist pressures acting on its exterior from the surrounding soil and is preferably easily assembled and aligned. An effective storm water system, therefore, is able to reliably resist both lateral soil pressures acting on the sides of the system, and vertical soil pressures acting on the system's top to maintain the storage area for the storm water runoff Vertical alignment provides continuity across lateral structural members to maintain compressive lateral strength in a buried condition.

A box structure system or storm tank may be constructed of separate structures (modules), which are arranged or connected to form a larger structure or assembly. Typically, these modules are positioned next to each other to form a layer of modules, a water drain tank assembly or a storm tank that is preferably buried in the ground, for example, beneath or adjacent a parking lot, housing development or other area where flash water runoff may occur during a heavy rainstorm or event. In some installations, multiple layers of modules are installed, where a second layer of modules is stacked onto the first. A prior art water drain tank or storm water tank and assembly is shown and described in U.S. Pat. No. 7,591,610, titled, "Water Drain Tank or Channel Module," which describes a water drain tank or channel module with stacked water-permeable lattice members or modules that are wrapped with a permeable geotextile material and buried at an appropriate location in the ground.

It is desirable to design, construct and deploy a storm tank assembly, comprised of a box structure or water drain tank structure and assembly, which is able to function in the challenging environment of a buried storm tank. It is also desirable to construct a storm tank assembly that is stackable and resists the structural loads encountered by the storm tank assembly when buried underground. A first row of assembled storm water drain tank modules or box structures preferably creates a generally flat or planar upper surface to facilitate stacking of a second row of assembled storm water drain tank modules or box structures. The preferred storm tank assembly facilitates efficient and simple installation and withstands the normal operating environment of the water drain tank or storm water tank system and assembly.

BRIEF SUMMARY OF THE INVENTION

Briefly stated, the preferred invention is directed to a storm water drain tank module for assembly into a storm water drain tank or storm tank assembly for storage of storm water. The storm water drain tank module includes a top platen, a bottom platen and a support spacer. The top platen has an upper surface and a top platen peripheral edge. The bottom platen has a bottom surface and a bottom platen peripheral edge. A plurality of column sockets is defined in the top and bottom platens. The support spacer is comprised of a plurality of columns. The plurality of columns is attached to adjoining ones of the plurality of column sockets to space the upper platen relative to the lower platen. A plurality of tabs and a plurality of slots are defined proximate the top and bottom platen peripheral edges, respectively. Each of the plurality of tabs extend outwardly away from the top and bottom platen peripheral edges, respectively, and each of the plurality of slots extends into the top and bottom platen peripheral edges. The plurality of slots is open in a lateral direction.

In another aspect, the preferred invention is directed to a storm water drain tank assembly for storage of storm water runoff. The storm water drain tank assembly includes a first tank module including a first top platen, a first bottom platen and a first plurality of columns. The first top platen includes a first peripheral edge, a first plurality of tabs positioned at the first peripheral edge and a first plurality of slots positioned at the first peripheral edge. The first plurality of tabs includes a first tab and the first plurality of slots including a first slot. A second tank module includes a second top platen including a second peripheral edge. A second plurality of tabs is positioned at the second peripheral edge and a second plurality of slots is positioned at the second peripheral edge. The second plurality of tabs includes a second tab and the second plurality of slots includes a second slot. The first tab is positioned in the second slot and the second tab is positioned in the first slot in an assembled configuration, wherein the first peripheral edge is position adjacent the second peripheral edge.

In a further aspect, the preferred invention is directed to a storm water drain tank assembly for storage of storm water runoff. The storm water tank assembly includes a first module with a first top platen, a first bottom platen and a first plurality of columns. The first top platen includes a first peripheral edge and a first pin hole therethrough. The storm water drain tank assembly also includes a second module having a second bottom platen with a second peripheral edge and a second pin hole, wherein the first peripheral edge is vertically aligned with the second peripheral edge and the first pin hole is aligned with the second pin hole in an assembled configuration. The storm water tank includes an alignment pin having an insertion end, a top end and a lip positioned at the top end. The alignment pin tapers from an insertion end diameter at the insertion end to a top end diameter at the top end. The insertion end diameter is smaller than the top end diameter. The alignment pin is positioned in the first and second pin holes in the assembled configuration. The first top platen also includes a first top platen surface and the second bottom platen includes a second bottom platen surface. The first top platen surface is positioned adjacent the second bottom platen surface in the assembled configuration. The alignment pin aligns the first top platen and the second bottom platen and, therefore, the first plurality of columns of the first module and a second plurality of columns of the second module such that column sockets of the first top platen and the second bottom platen are aligned in the assembled configuration. In the assembled configuration, accordingly, pairs of the first and second plurality of columns are aligned for efficient transfer of loads through the assembly and into the surrounding ground. In a shear condition, the pin maintains alignment, transferring load from the first or second platen to the other of the first or second platen, respectively, across the first and second modules or parts and across the plane between the first and second modules.

In an alternative aspect, the preferred invention is directed to a storm water drain tank module for assembly into a storm water drain tank for storage of storm water. The storm water drain tank module includes a top platen, a bottom platen and a support spacer. The top platen has an upper surface and a top platen peripheral edge. The bottom platen has a bottom surface and a bottom platen peripheral edge. The support spacer is attached to the top and bottom platens to space the top platen relative to the bottom platen generally in a parallel orientation. A plurality of tabs and a plurality of slots are defined proximate the top and bottom platen peripheral edges, respectively. Each of the plurality of tabs extends outwardly away from the top and bottom platen peripheral edges, respectively, and each of the plurality of slots extends into the top and bottom platen peripheral edges, respectively.

In a further aspect, the preferred invention is directed to a storm water drain tank assembly for storage of storm water runoff. The storm water drain tank assembly includes a first module having a first top platen, a first bottom platen and a first support spacer and a second module including a second top platen, a second bottom platen and a second support spacer. A first plurality of tabs extends laterally outwardly from the first top platen, the first bottom platen or the first support spacer and a first plurality of slots extends laterally inwardly into the first top platen, the first bottom platen or the first support spacer. The first plurality of tabs includes a first tab and the first plurality of slots including a first slot. A second plurality of tabs extends laterally outwardly from the second top platen, the second bottom platen or the second support spacer and a second plurality of slots extends laterally inwardly into the second top platen, the second bottom platen or the second support spacer. The second plurality of tabs includes a second tab and the second plurality of slots includes a second slot. The first tab is positioned in the second slot and the second tab is positioned in the second slot in an assembled configuration.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
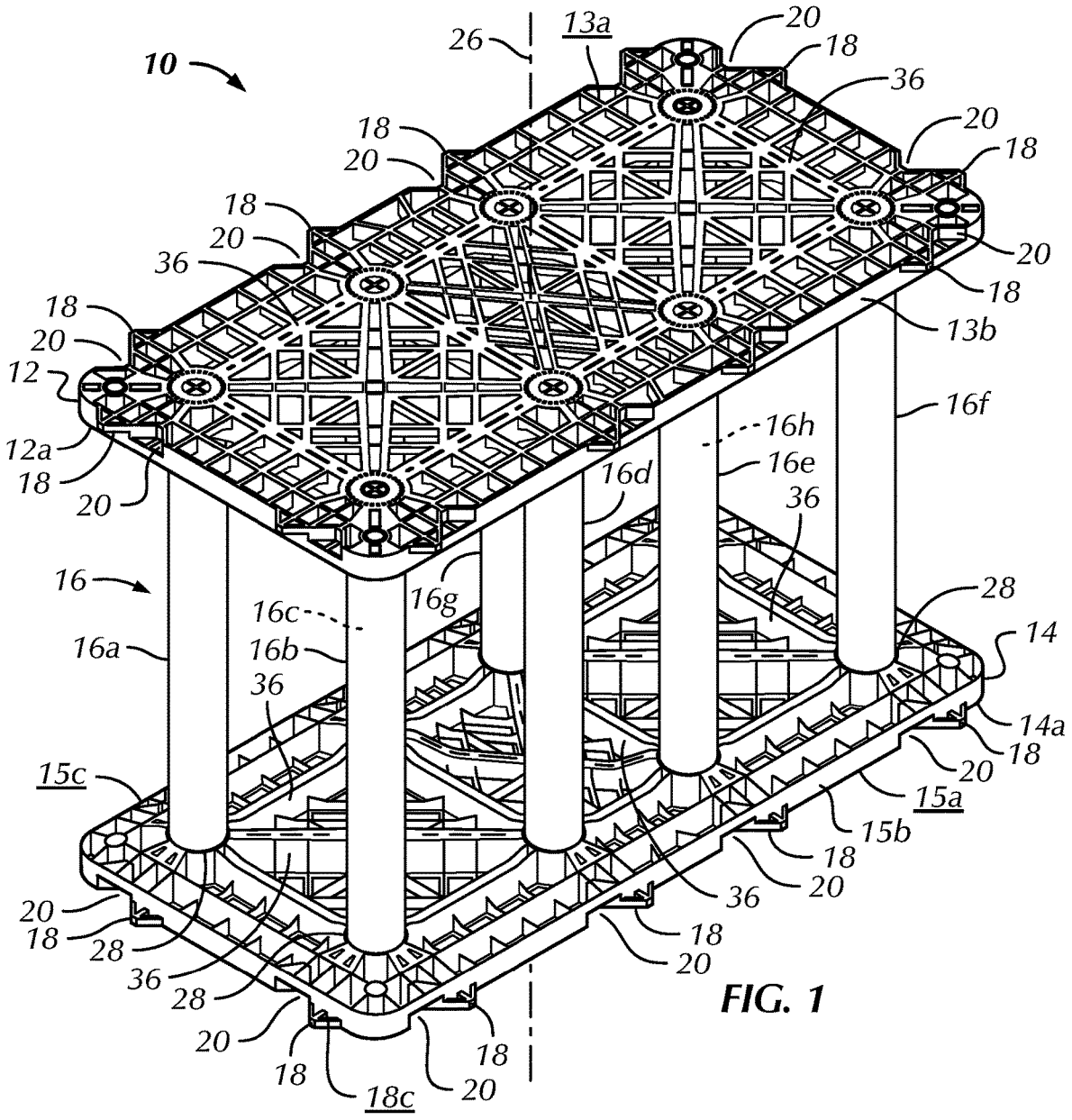
FIG. 1 is a top perspective view of a storm water drain tank module in accordance with a preferred embodiment of the present invention.
Figure 2:
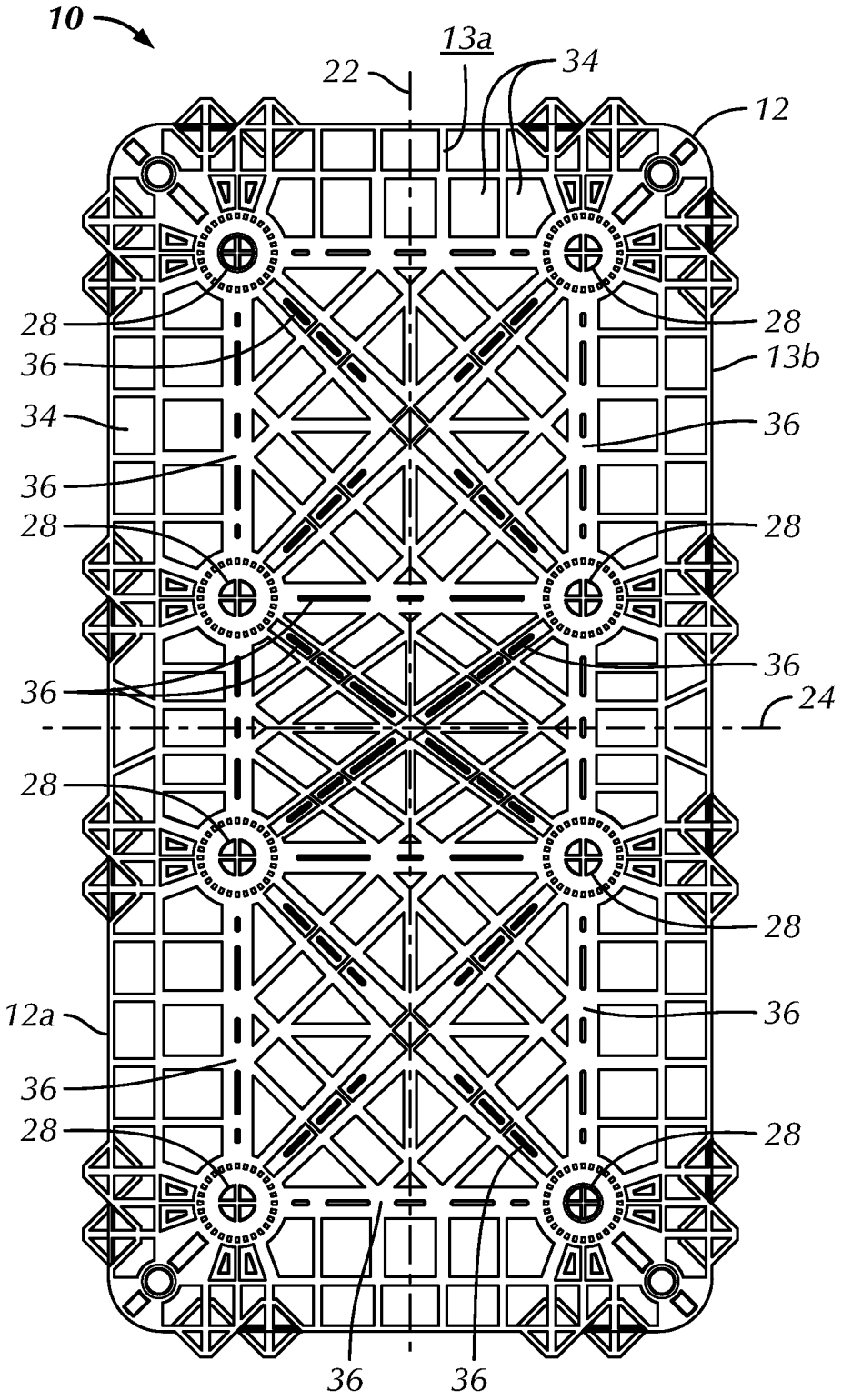
FIG. 2 is a top plan view of the storm water drain tank module of FIG. 1.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally" and "outwardly" or "proximally" refer to directions toward and away from, respectively, the geometric center or orientation of the water drain tank modules and assemblies and related parts thereof. The terminology includes the above-listed words, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to FIGS. 1-11, the preferred invention is directed to a storm water drain tank module, generally designated 10, that includes two (2) platens, including a top platen 12 and a bottom platen 14, and a structural support spacer 16. The support spacer 16 is attached to the top and bottom platens 12, 14 to space the top platen 12 relative to the bottom platen 14, preferably with the top and bottom platens 12, 14 oriented generally parallel relative to each other. The structural support spacer 16 provides structural support to carry load and space the top platen 12 relative to the bottom platen 14. In the preferred embodiment, the support spacer 16 is comprised of a plurality of columns, more preferably eight (8) columns, including first, second, third, fourth, fifth, sixth, seventh and eighth columns 16*a*, 16*b*, 16*c*, 16*d*, 16*e*, 16*f*, 16*g*, 16*h*. The support spacer 16 is not limited to being comprised of the eight columns 16*a*, 16*b*, 16*c*, 16*d*, 16*e*, 16*f*, 16*g*, 16*h* and may be comprised of nearly any structure that is designed and configured to space the top platen 12 from the bottom platen 14, carry loads to and between the top and bottom platens 12, 14 and withstand the normal operating conditions of the support spacer 16. The support spacer 16, for example, may be comprised of peripheral walls (not shown) that extend between top and bottom platen peripheral edges 13*b*, 15*b*, panels (not shown) that are attached between the top and bottom platens 12, 14, integrally molded structures (not shown) that space the top platen 12 from the bottom platen 14 and other similar structural supports that space the top platen 12 from the bottom platen 14. The support spacer 16 also preferably provides open space between the top and bottom platens 12, 14 so that water, drain fluid and other materials may be positioned between and contained within a space between the top and bottom platens 12, 14 during use, as is described in greater detail below.

The storm water drain tank modules 10 are preferably utilized in an assembly of pluralities of the storm water drain tank modules 10 to define a storm tank (not shown) for storage of storm water. The storm tank is typically assembled in a pit and substantially buried in soil or other ground supporting material beneath or adjacent to an area, such as a parking lot or housing development, where storm water runoff is desirable to control or manage. The support spacer 16 spaces the top platen 12 from the bottom platen 14 and provides structural support for the storm water drain tank module 10. The storm water drain tank module 10 is not limited to the eight columns 16*a*, 16*b*, 16*c*, 16*d*, 16*e*, 16*f*, 16*g*, 16*h* comprising the support spacer 16 of the preferred embodiment and may include less or more columns 16*a*, 16*b*, 16*c*, 16*d*, 16*e*, 16*f*, 16*g*, 16*h*, which generally transfer compression loads, or other structures that space the top platen 12 from the bottom platen 14, as was described above. In an alternative preferred embodiment, the storm water drain tank module 10 may, for example, include three columns 16*a*, 16*b*, 16*c* attached between the top and bottom platens 12, 14, four (4) columns 16*a*, 16*b*, 16*f*, 16*h* positioned generally at corners of the preferably rectangular shaped top and bottom platens 12, 14 or columns 16*a*, 16*b*, 16*f*, 16*h* for each corner of variously shaped top and bottom platens 12, 14, such as eight columns 16*a*, 16*b*, 16*c*, 16*d*, 16*e*, 16*f*, 16*g*, 16*h* for top and bottom platens 12, 14 having an octagonal shape (not shown). The storm water drain tank module 10 preferably includes at least four columns 16*a*, 16*b*, 16*f*, 16*h* for supporting the preferred rectangular shaped platens 12, 14 positioned near the corners of the platens 12, 14 or may alternatively include six columns 16*a*, 16*b*, 16*c*, 16*d*, 16*f*, 16*h* with four of the columns 16*a*, 16*b*, 16*f*, 16*h* positioned near corners of the rectangular shaped platens 12, 14 and two columns 16*c*, 16*d* mounted near a midline of the platens 12, 14. The number of columns 16*a*, 16*b*, 16*c*, 16*d*, 16*f*, 16*h* for each module 10 may be driven by the size, shape and configuration of the top and bottom platens 12, 14 or other design considerations.

Figure 3:
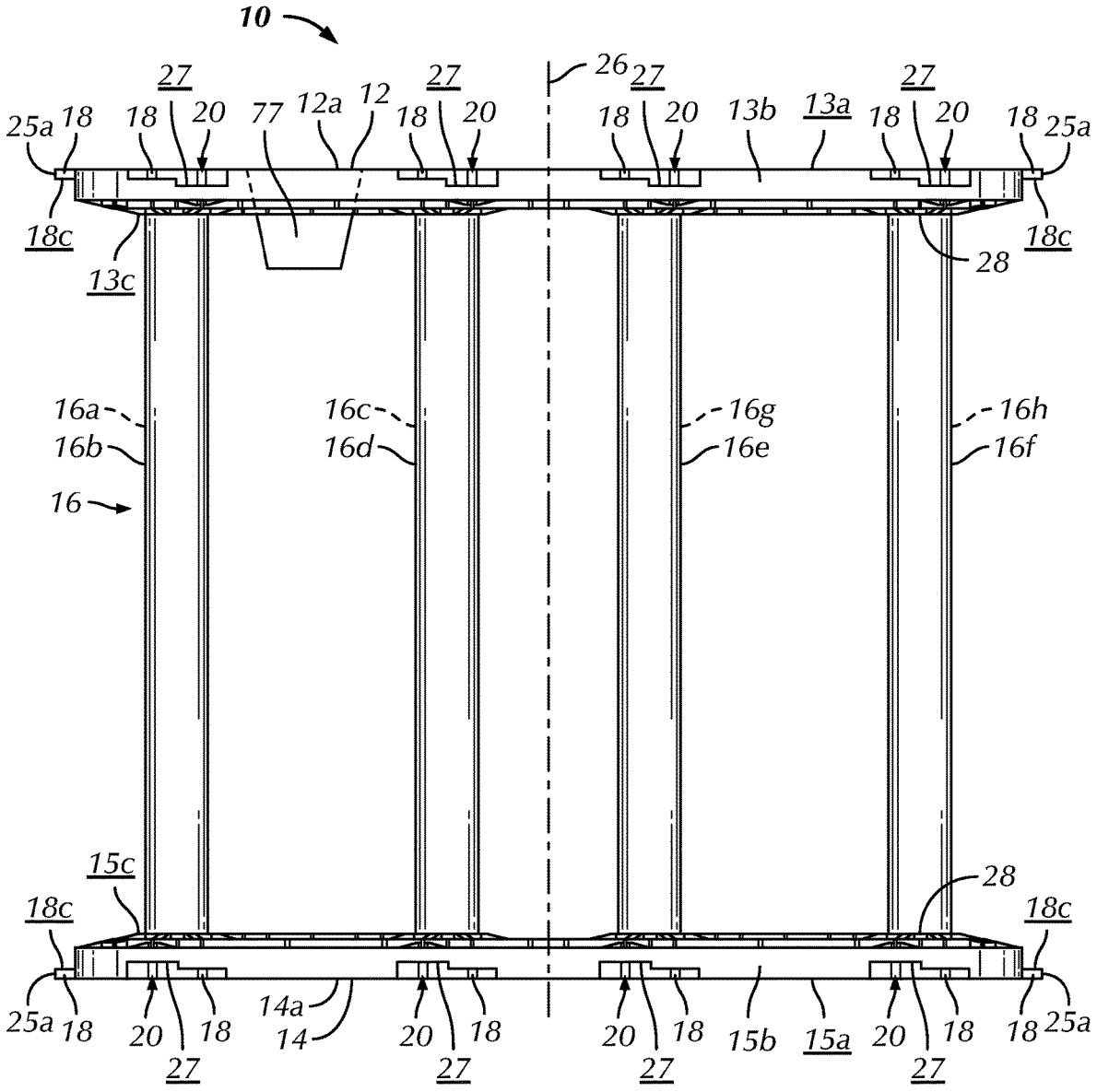
FIG. 3 is a side elevational view of the storm water drain tank module of FIG. 1.
Figure 4:
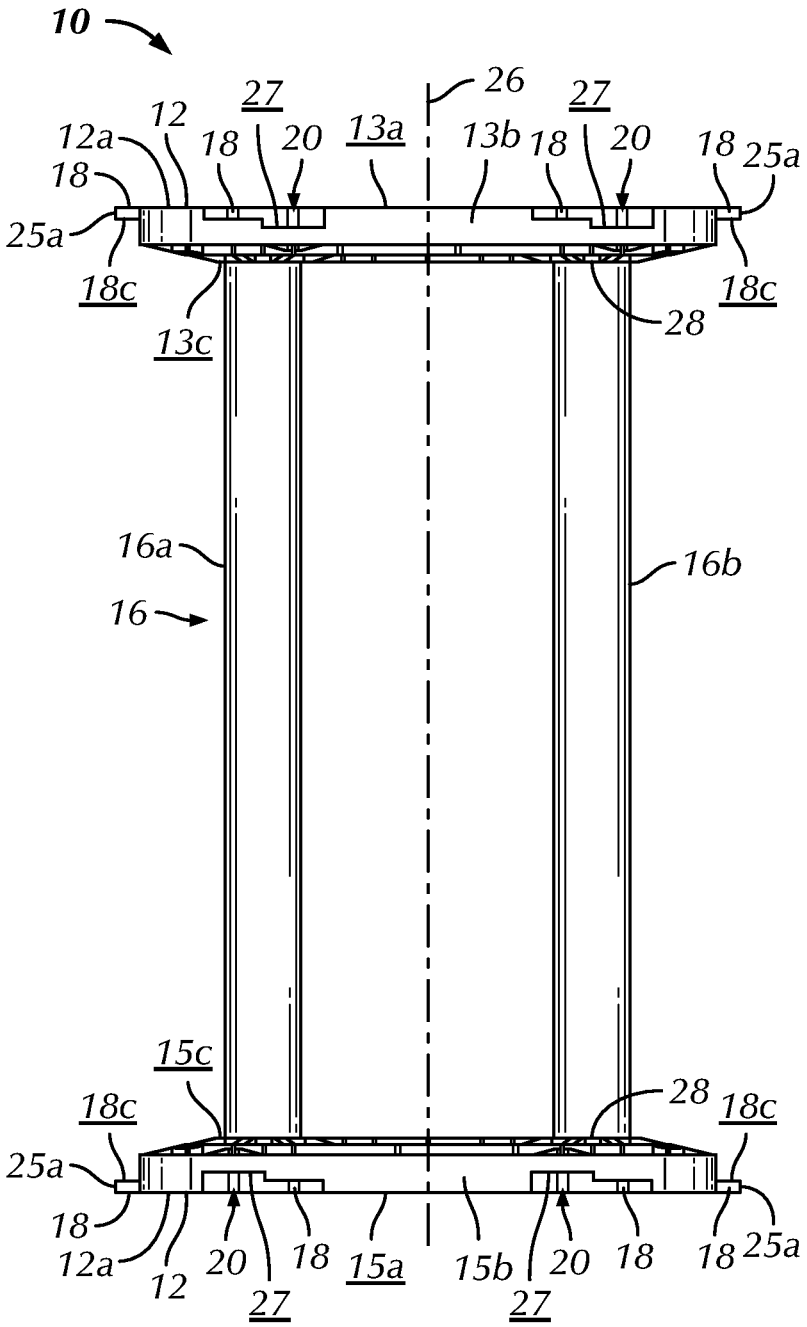
FIG. 4 is a front elevational view of the storm water drain tank module of FIG. 1.

The top platen 12 has an upper surface 13*a* and a top platen peripheral edge 13*b*. The top platen 12 also has a lower surface 13*c* spaced from the upper surface 13*a* that faces the bottom platen 14 in an assembled configuration (FIGS. 1, 3 and 4). The upper surface 13*a* is preferably planar and the preferred lower surface 13*c* has some curvature or chamfers inwardly from the top platen peripheral edge 13*b*. The top and bottom platens 12, 14 preferably have relief holes 34 therethrough that permit water or other fluid to flow through the top and bottom platens 12, 14, generally perpendicularly relative to the top surface 13*a* and to limit the weight of the top and bottom platens 12, 14. The top and bottom platens 12, 14 are not limited to having the relief holes 34 therethrough, to having the planar top surface 13*a* or the non-planar lower surface 13*c* and may be otherwise designed and configured to perform the preferred functions of the top and bottom platens 12, 14, such as transmitting loads into the support spacer 16 and into adjacent soil or support structures and to otherwise create structural support and spacing for the storm water tank. The bottom platen 14 preferably has a bottom surface 15*a*, a bottom platen peripheral edge 15*b* and an upward surface 15*c*, wherein the bottom surface 15*a* faces away from the support spacer 16 and the upward surface 15*c* faces toward the support spacer 16 in the assembled configuration. The bottom surface 15*a*, similar to the upper surface 13*a*, is preferably planar within the bottom platen peripheral edge 15*b* and the preferred upward surface 15*c*, similar to the lower surface 13*c*, is non-planar having some curvature or chamfers inwardly from the bottom platen peripheral edge 15*b*, generally to preserve material and reduce weight of the platens 12, 14. The lower surface 13*c* of the top platen 12 and the upward surface 15*c* of the bottom platen 14 are not limited to being non-planar and may be generally planar or have alternative shapes and configurations that are able to withstand the normal operating conditions of the platens 12, 14 and perform the preferred functions of the platens 12, 14.

The top and bottom platens 12, 14 preferably have the same or similar size, shape and configuration, with the bottom platen 14 being substantially the same as the top platen 12, but attached to the support spacer 16 such that the bottom platen 14 is positioned below the top platen 12 in the assembled configuration. The top platen 12 may, accordingly, be utilized as the bottom platen 14 by overturning the storm water drain tank module 10. In the assembled configuration, the upper surface 13*a* of the top platen 12 and the bottom surface 15*a* of the bottom platen 14 are preferably oriented generally parallel relative to each other to facilitate stacking of pluralities of modules 10, as is described in greater detail below. Certain of the features of the top and bottom platens 12, 14 are generically described herein, as the top and bottom platens 12, 14 have generally the same or similar features, with the top platen 12 being substantially the same as the bottom platen 14 in size, shape, design and configuration. The top and bottom platens 12, 14 of the preferred embodiment are substantially symmetrical in the assembled configuration and provide for proper alignment of the slots 20 and tabs 18 in the assembled configuration. The design and configuration of the assembled modules 10 that form a storm tank for storing water runoff with the engaged tabs 18 and slots 20 generally prevents the soil structure under the assembly from destabilizing the assembly or the storm tank. Individual modules 10 in the storm tanks generally do not move downwardly or otherwise relative to other modules 10 because of the engagement of the slots 20 and the tabs 18 between the modules 10. The assembly of modules 10 or the storm tank, thereby stabilizes the soil upon which the storm tank is mounted so that the assembly of modules 10 is consistently supported by the underlying soil.

The top and bottom platens 12, 14 and the support spacer 16 are preferably constructed of a generally stiff and strong polymeric material, such polypropylene ("PP") or polyvinyl chloride ("PVC"), most preferably the platens 12, 14 are constructed of the PP material and the preferred columns 16*a*, 16*b*, 16*c*, 16*d*, 16*e*, 16*f*, 16*g*, 16*h* are constructed of the PVC material, but the platens 12, 14 and columns 16*a*, 16*b*, 16*c*, 16*d*, 16*e*, 16*f*, 16*g*, 16*h* are not so limited and may be constructed of nearly any relatively stiff and strong structural material that is able to take on the general size and shape of the platens 12, 14 and the support spacer 16, withstand the normal operating conditions of the platens 12, 14 and the support spacer 16 and perform the typical functions of the platens 12, 14 and the support spacer 16, as is described in further detail herein. The storm water drain tank module 10 preferably includes multiple or a plurality of storm water drain tank module 10, such as first, second, third, fourth and fifth modules 10*a*, 10*b*, 10*c*, 10*d*, 10*e*, that are assembled together into a storm tank or storm water tank assembly that is installed, wrapped in a synthetic, permeable sheeting, fitted with side panels at sides of the assembly and buried to create a permeable tank for storm water runoff. The side panels and synthetic wrap or surrounding fabric/membrane 77 are partially depicted in FIG. 3, but generally surround the assembled modules 10, at least at sides of the modules 10 in the assembled and buried configurations. Each of the modules 10, 10*a*, 10*b*, 10*c*, 10*d*, 10*e*, as well as the platens 12, 14, defines a longitudinal axis 22, a lateral axis 24 and a vertical axis 26. The storm water tank assemblies may include nearly any number of storm water drain tank modules 10 assembled in side-by-side and stacked arrangements, generally based on volume requirements for the storm tank and related design considerations. The assembled storm water drain tank modules 10 may also include side panels (not shown) that mount to sides of the outermost storm water drain tank modules 10 in the assembly to transfer loads from surrounding soil and a surrounding fabric/membrane to the structure and to limit and prevent surrounding soil from entering into the storm tank, along with the preferred surrounding fabric/membrane during use, but the side panels and the surrounding fabric/membrane are not required for operation of the storm water drain tank modules 10.

The first module 10*a* preferably includes a first top platen 12*a*, a first bottom platen 14*a* and the support spacer 16, which is comprised of a first plurality of columns 16, 16*a*, 16*b*, 16*c*, 16*d*, 16*e*, 16*f*, 16*g*, 16*h* in the preferred embodiment. The first top platen 12*a* includes the top platen or first peripheral edge 13*a*, a first plurality of tabs 18 positioned at the first peripheral edge 13*a* and a first plurality of slots 20 positioned at the first peripheral edge 13*a*. The first plurality of tabs 18 includes a first tab 18 and the first plurality of slots 20 includes a first slot 20. In the preferred embodiment, the first plurality of tabs 18 includes twelve (12) tabs 18 extending from the first peripheral edge 13*a* and the first plurality of slots 20 includes twelve (12) slots 20 extending into the first peripheral edge 13*a*. The preferred first top platen 12*a* and each of the top and bottom platens 12, 14 of the preferred embodiment include twelve tabs 18 and twelve slots 20 with two tabs 18 and slots 20 on each of the front and rear ends of the platens 12, 14 and four tabs 18 and slots 20 on each of the side or long ends of the platens 12, 14. The platens 12, 14 are not limited to including the twelve tabs 18 and slots 20 or to the particular arrangement of tabs 18 and slots 20 of the preferred embodiment and may have less or additional tabs 18 and slots 20, depending on designer preferences and storm water tank assembly requirements.

Figure 5:
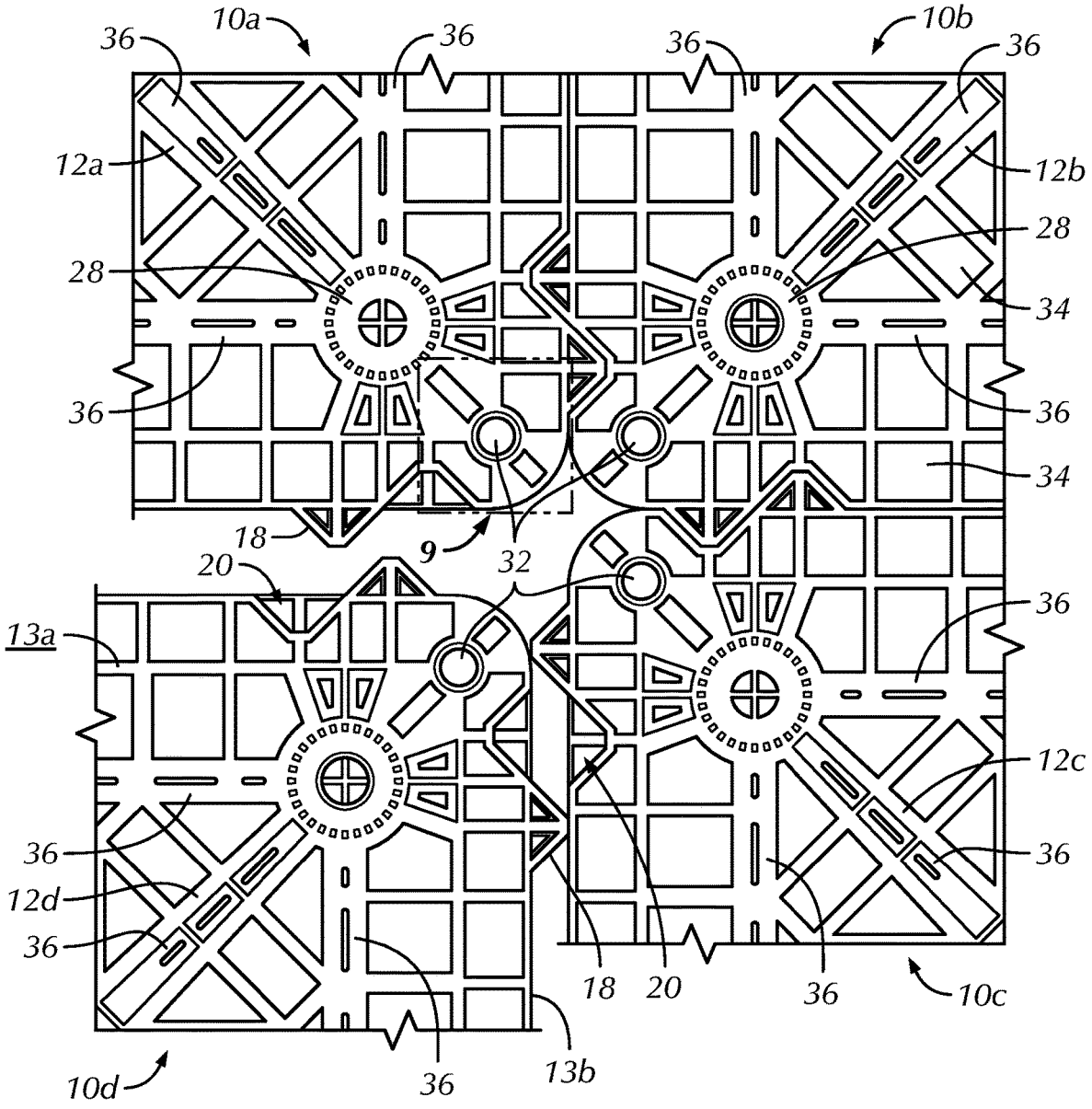
FIG. 5 is a top plan view of corners of four storm water drain tank modules of FIG. 1, wherein three of the storm water drain tank modules are positioned in an assembled configuration and a fourth storm water drain tank module is being positioned for assembly.
Figure 6:
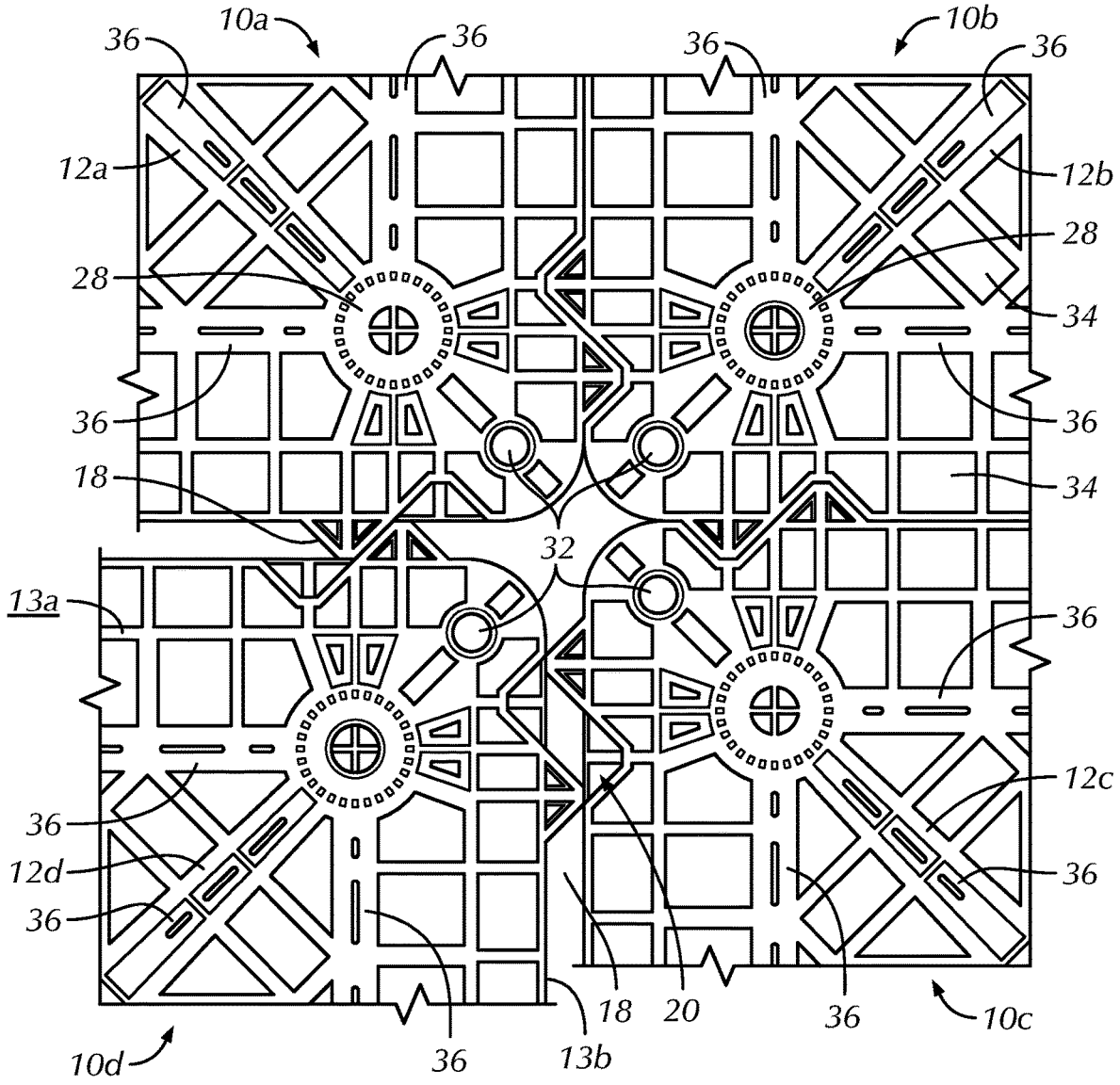
FIG. 6 is a top plan view of the corners of the four storm water drain tank modules of FIG. 5, wherein the fourth storm water drain tank module is further positioned for assembly.
Figure 7:
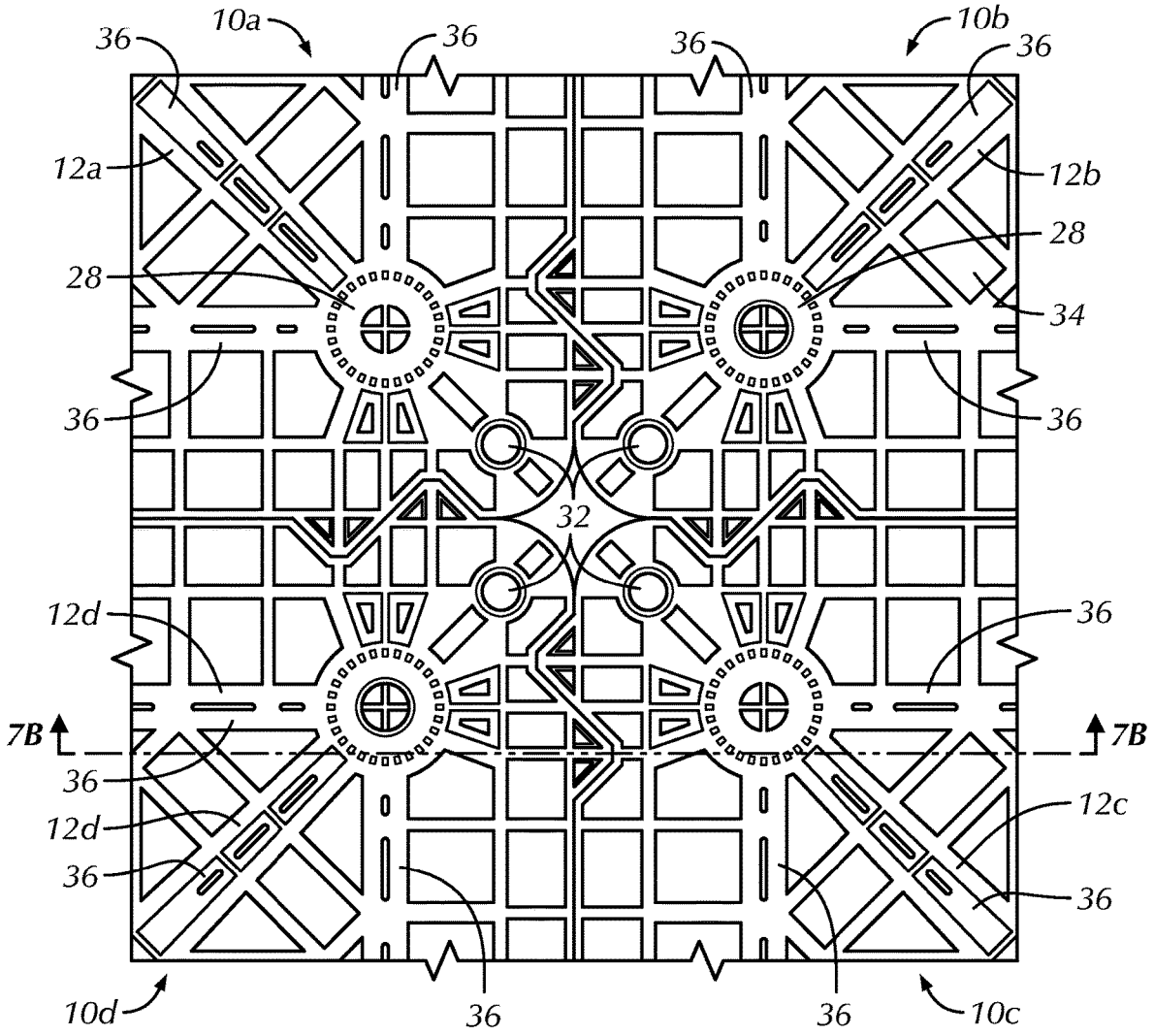
FIG. 7 is a top plan view of the corners of the four storm water drain tank modules of FIG. 5, wherein the four storm water drain tank modules are positioned in an assembled configuration.

The storm water tank assembly also includes the second module 10*b* having a second top platen 12*b* with a second peripheral edge 13*b*, a second plurality of tabs 18 positioned at the second peripheral edge 13*b* and a second plurality of slots 20 positioned at the second peripheral edge 13*b*. The second plurality of tabs 18 includes a second tab 18 and the second plurality of slots 20 includes a second slot 20. The first tab 18 of the first top platen or first platen 12*a* is positioned in the second slot 20 of the second top platen or second platen 12*b* and the second tab 18 of the second top platen or the second platen 12*b* is positioned in the first slot 20 of the first top platen or first platen 12*a* in the assembled configuration (FIGS. 5-7). In the assembled configuration, the first peripheral edge 13*b* of the first top platen 12*a* is positioned adjacent the second peripheral edge 13*a* of the second top platen or second platen 12*b*. The third, fourth and fifth modules 10*c*, 10*d*, 10*e* also include third, fourth and fifth top platens 12*c*, 12*d*, each with the plurality of tabs 18 and slots 20 at the respective peripheral edges 13*b*. In addition, the first and second pluralities of tabs 18 and slots 20 are not limited to being connected to the top and bottom platens 12, 14 and may be connected to the support spacer 16, as long as the connecting tabs 18 and slots 20 are engaged in the assembled configuration to maintain alignment and positioning of the storm water drain tank modules 10 relative to each other in the assembled configuration. In the preferred embodiment, each of the plurality of tabs 18 is integrally formed with its associated top or bottom platen 12*a*, 12*b*, such as by injection molding, machining or otherwise integrally forming the tabs 18 with the platens 12. The tabs 18 are not so limited and may be separately formed and attached to the platens 12 or otherwise designed and configured to perform the functions of the tabs 18, withstand the normal operating conditions of the tabs 18 and take on the general size and shape of the tabs 18.

During a storm tank installation, the storm water drain tank modules 10 are placed adjacent to each other, so that the respective tabs 18 and slots 20 on adjacent top and bottom platens 12, 14 nest or engage with each other, which aligns the adjacent storm water drain tank modules 10, such as the first, second, third and fourth modules 10*a*, 10*b*, 10*c*, 10*d*, wherein the matching tabs 18 and slots 20 of the first, second, third and fourth top platens 12*a*, 12*b*, 12*c*, 12*d* nest or engage with each other in the assembled configuration (FIGS. 5-7). The tabs 18 and slots 20 include the plurality of tabs 18 and the plurality of slots 20 defined proximate the top platen peripheral edges 13*b* and the bottom platen peripheral edges 15*b* of the respective modules 10, 10*a*, 10*b*, 10*c*, 10*d*, 10*e*. Each of the plurality of tabs 18 extends outwardly away from the top and bottom platen peripheral edges 13*b*, 15*b*, respectively. In addition, each of the plurality of slots 20 extends into the top and bottom platen peripheral edges 13*b*, 15*b*. In the preferred embodiment, the tabs 18 and slots 20 are positioned in pairs adjacent to each other, but are not so limited and may be spaced from each other or otherwise arranged. In the preferred embodiment, the first tab 18 and the first slot 20 of the first top platen 12*a* are positioned adjacent to each other and the second tab 18 and the second slot 20 of the second top platen 12*b* are positioned adjacent to each other, thereby defining pairs of slots 18 and tabs 20 on the platens 12. The first, second and third modules 10*a*, 10*b*, 10*c* may be moved generally horizontally, substantially along the longitudinal or lateral axes 22, 24, respectively, to assemble the pairs of tabs 18 and slots 20 (FIGS. 5-7). Once the first, second and third modules 10*a*, 10*b*, 10*c* are assembled, the fourth module 10*b* preferably moves laterally and longitudinally relative to the first, second and third modules 10*a*, 10*b*, 10*c* to engage the adjoining tabs 18 and slots 20 of the fourth module 10*d* to the slots 20 and tabs 18 of the first and third module 10*a*, 10*c* (FIGS. 5-7). The movement of the fourth module 10*d* relative to the first and third module 10*a*, 10*c* is at least partially guided by sliding engagement between tab legs 19*a*, 19*a* of the tabs 18 and slot legs 21*a*, 21*b* of the slots 20 (FIGS. 5-8). This generally horizontal movement of the fourth module 10*d* generally horizontally to engage the already assembled first, second and third modules 10*a*, 10*b*, 10*c* generally eliminates or reduces any required vertical movement of the fourth module 10*d* to assemble to or engage the first, second and third modules 10*a*, 10*b*, 10*c* to define an assembly of the first, second, third and fourth module 10*a*, 10*b*, 10*c*, 10*d*.

In the preferred embodiment, the tabs 18 and the slots 20 are generally identified and described generically, as each of the tabs 18 and slots 20 are substantially the same, except for their positioning on the top and bottom platen peripheral edges 13*b*, 15*b*, although the tabs 18 and slots 20 are not so limited. The tabs 18 each preferably have a substantially trapezoid shape extending away from the top and bottom platen peripheral edges 13*b*, 15*b* and adjacent the upper and bottom surfaces 13*a*, 15*a*, respectively. The tabs 18 each preferably have a pair of tab legs 19*a*, 19*b* (FIG. 8) extending outwardly from the top and bottom platen peripheral edges 13*b*, 15*b* proximate the upper surface 13*a* of the top platen 12 and proximate the bottom surface 15*a* of the bottom platen 14, respectively. The tab legs 19*a*, 19*b* taper in a generally linear fashion from the peripheral edges 13*b*, 15*b* outwardly, but are not so limited and may have an arcuate or other taper, as long as the tab legs 19*a*, 19*b* taper from a larger width at the peripheral edges 13*b*, 15*b* to a narrower width spaced from the peripheral edges 13*b*, 15*b*. The tab legs 19*a*, 19*b* extend from the top and bottom platen peripheral edges 13*b*, 15*b*, which extend substantially parallel to the longitudinal axis 22 or the lateral axis 24, at a tab angle Θ. In the preferred embodiment, the tab angle Θ is approximately forty-five degrees (45°), but is not so limited and may extend at other angles relative to the top and bottom platen peripheral edges 13*b*, 15*b*, such as approximately thirty to sixty degrees (30-60°). The forty-five degree (45°) tab angle Θ, however, is preferred to facilitate the angular engagement or assembly of the adjacent storm water drain tank modules 10, as is described in greater detail below. The tabs 18 preferably have a blunt nose or tip 25*a* spaced from the peripheral edges 13*b*, 15*b* to define the trapezoid shape that mates with the trapezoid shaped slots 20, although the tabs 18 and slots 20 are not limited to having trapezoid shapes and may have nearly any shape that facilitates engagement between the tabs 18 and slots 20, such as triangular or other shapes that facilitate slidable engagement and positioning of the tabs 18 within the slots 20 in the preferred embodiment. For example, the tabs 18 and slots 20 may be comprised of a pin (not shown) extending from the support spacer 16 that engages a hole or recess (not shown) in the support spacer 16 of an adjacent module to engage the adjacent storm water drain tank modules 10 relative to each other in the assembled configuration. The tabs 18 and slots 20 preferably maintain alignment of the top and bottom platens 12, 14 of the adjacent storm water drain tank modules 10 in the assembled configuration to facilitate load transfer between the top and bottom platens 12, 14, respectively, of adjacently assembled storm water drain tank modules 10.

In the preferred embodiment, the slots 20 each also have the trapezoidal shape that extends into the top and bottom peripheral edges 13*b*, 15*b* with a blunt or flattened bottom at its inwardly most portion relative to the top and bottom platens 12, 14. Each of the slots 20 has a pair of slot legs 21*a*, 21*b* extending inwardly from the top and bottom platen peripheral edges 13*b*, 15*b* proximate the top and bottom surfaces 13*a*, 15*a* at a slot angle A. The preferred slot angle is approximately forty-five degrees (45°), but is not so limited and may be in a range of approximately thirty to sixty degrees (30-60°) and preferably is arranged and configured to match with mating tabs 18 on adjacent platens 12, 14 in the assembled configuration. The slots 20 are not limited to having the trapezoidal shape and may have alternate shapes that are able to mate with the tabs 18, such as triangular or other shapes that are able to withstand the normal operating conditions of the slots 20 and perform the preferred functions of the slots 20, as is generally described herein. The slots 20 are preferably open in a lateral outward direction from the top and bottom platens 12, 14, respectively, which is substantially perpendicular to the longitudinal axis 26 and at least between where the pair of slot legs 21*a*, 21*b* that join the top and bottom platen peripheral edges 13*b*, 15*b*, respectively. The opening at the edge of the slots 20 at the peripheral edges 13*b*, 15*b* facilitates sliding of the tabs 18 into the slots 20 from the lateral direction, as is described in greater detail below.

The mouth or opening 23*a* of each of the slots 20 that is defined generally at the peripheral edges 13*b*, 15*b* preferably has a mouth width WM that is greater than a width of any other portion of the slots 20 between the peripheral edges 13*b*, 15*b* and bottom or butt ends 23*b* of the slots 20. The slots 20, therefore, have their widest portion at the mouth 23*a*, which is comprised of the mouth width WM, to facilitate insertion of the tabs 18, generally laterally and/or longitudinally into the slots 20. The slots 20 and, specifically, the slot legs 21*a*, 21*b*, taper inwardly from the mouth 23*a* to the bottom or but ends 23*b* of the slots 20 opposite the mouth 23*a*. The slot legs 21*a*, 21*b* have a generally straight taper in the preferred embodiment, but are not so limited and may have arcuate or other configurations, as long as the slot legs 21*a*, 21*b* preferably taper in size from the larger mouth 23*a* at peripheral edges 13*b*, 15*b* to the smaller or narrower butt ends 23*b*.

In the assembled configuration, tips 25*a* of the tabs 18 are positioned adjacent the bottom or butt ends 23*b* of the slots 20 of mating tabs 18 and slots 20, respectively. In the preferred embodiment, a base of the tabs 18 defines a base width WB measured proximate the peripheral edges 13*b*, 15*b* that is substantially the same and may be slightly smaller than the mouth width WM. The tabs 18 taper from the base width WB near the peripheral edges 13*b*, 15*b* toward the tips 25*a* such that the greatest width of the tabs 18 is at the base width WB and the smallest width is at the tips 25*a*. The tapers of the tabs 18 and the slots 20 facilitate positioning of the tabs 18 into the slots 20 in the assembled configuration with the tips 25*a* of the tabs 18 positioned proximate the butt ends 23*b* of the slots 20, the base width WB generally accommodated by the mouth width WM and bottom surfaces 27 of the slots 20 positioned adjacent or in facing engagement with the lower surfaces 18*c* of the tabs 18. In the preferred embodiment, the mouth and base widths WM, WB are approximately one-half to twelve inches (½-12"), but are not so limited and may have larger or smaller sizes based on design considerations, sizes of the modules 10, expected loading, expected operating environments and other relevant design factors. In the preferred embodiment, the butt ends 23*b* are generally flat or blunt, but are not so limited and may come to a point such that the slots 20 have a generally triangular shape. In such a configuration with generally triangularly-shaped slots 20, additional relief is provided between the tips 25*a* of the tabs 18 and the butt ends 23*b* in the assembled configuration to accommodate debris that may be present during assembly.

The engagement or positioning of the lower surfaces 18*c* of the tabs 18 relative to the bottom surfaces 27 of the slots 20 of the opposing top and bottom platens 12*a*, 12*b* in the assembled configuration of multiple modules 10, such as the first, second, third and fourth modules 10*a*, 10*b*, 10*c*, 10*d*, generally engages the multiple modules 10 together and limits or prevents vertical movement of the modules 10 relative to each other along the vertical axis 26. There is, however, preferably a space between the lower surfaces 18*c* of the tabs 18 and the bottom surfaces 27 of the slots 27 in the assembled configuration to facilitate assembly, provide for limited movement along the vertical axis 26 and to accommodate foreign objects that may be encountered in the operating environment, as is further described herein. In addition, in the assembled configuration, the respective upper and bottom surfaces 13*a*, 15*a* of assembled and adjacent modules 10, such as the first, second, third and fourth modules 10*a*, 10*b*, 10*c*, 10*d*, are generally coplanar with each other to facilitate positioning of the assembled modules 10 on a flat support or ground surface and stacking of additional rows of the modules 10 on a first or lower row of modules 10. The tabs 18 are also preferably tapered from a smallest thickness at the tips 25*a* to a greater thickness at their base to facilitate assembly and provide some forgiveness in the assembly by reducing potential interference of the tabs 18 with the peripheral edges 13*b*, 15*b* with the lower profile or reduced thickness tips 25*a* of the tabs 18.

The preferred tabs 18 also define a tab depth Dx measured from the base of the tabs 18 at the peripheral edges 13*b*, 15*b* to the tips 25*a* and the slots 20 define a slot depth Ds measured from the butt ends 23*b* to the peripheral edges 13*b*, 15*b*, generally parallel to the longitudinal or lateral axes 22, 24, respectively. The tab depth Dx and the slot depth Ds are preferably, substantially the same with the slot depth Ds being slightly greater than the tab depth Dx to accommodate insertion of the tabs 18 into the slots 20 in the assembled configuration. In the preferred embodiment, the tab and slot depths Dx, Ds are preferably approximately one-quarter to four inches (¼-4") depending on the size of the modules, designer preferences, operating environment and other relevant factors.

In the preferred embodiment, each of the platens 12, 14 includes two slots 20 and tabs 18 on each peripheral edge 13*b*, 15*b*, thereby including at least eight (8) tabs 18 and eight (8) slots 20 in the preferred rectangular shaped platens 12, 14, although the platens 12, 14 are not so limited and may include less or more tabs 18 and slots 20, depending on designer preferences and configurations. In the preferred embodiment, each of the platens 12, 14 includes twelve (12) tabs 18 and twelve (12) slots 20, with two pairs of tabs 18 and slots 20 at ends of the platens 12, 14 and four pairs of tabs 18 and slots 20 on each of the long peripheral edges 13*b*, 15*b* of the platens 12, 14. The slots 20 are also preferably open through the upper and bottom surfaces 13*a*, 15*a*, respectively, and form bottom surfaces 27 that define slot void or the slots 20 in combination with the slot legs 21*a*, 21*b*. The bottom surfaces 27 and the slot legs 21*a*, 21*b* generally set the boundaries or define the slots 20. The mating tabs 18 are positioned within the slot voids or slots 20, respectively, in the assembled configuration with the tab legs 19*a*, 19*b* positioned in facing engagement or adjacent to the slot legs 21*a*, 21*b* and the bottom surfaces 27 of the slots 20 in facing engagement or adjacent to lower surfaces 18*c* of the tabs 18 in the assembled configuration. The positioning of the legs 19*a*, 19*b* and the slot legs 21*a*, 21*b* in facing engagement or adjacent to each other limits lateral and longitudinal movement (along the longitudinal axis 22 and lateral axis 24) of the adjacent platens 12, 14 relative to each other and positioning of the bottom surfaces 27 of the slots 20 and the lower surfaces 18*c* of the tabs 18 in facing engagement or adjacent to each other limits vertical movement (along the vertical axis 26) of the adjacent platens 12, 14 relative to each other in the assembled configuration.

Once buried, the installation is subjected to loading from the surrounding soil. To resist the vertical loading from the soil directly above the top platens 12 of the storm water drain tank modules 10 in the assembled storm tank, the top platens 12 accept the load from the soil and transfer it to the support spacer 16. The load is at least partially transferred through the top platens 12 directly to the support spacer 16 by support beams 36, which will be described in greater detail below, that extend directly between adjacent column sockets 28 of the preferred embodiment of the platens 12, 14. The support spacer 16, which is comprised of the eight columns 16*a*, 16*b*, 16*c*, 16*d*, 16*e*, 16*f*, 16*g*, 16*h* in the preferred embodiment, then transfers the load into the bottom platens 14, which sends the load to the soil below, also preferably directly away from the sockets 28 by the support beams 36. To resist the lateral loading from the soil surrounding the perimeter of the storm tank, side panels and peripheral edges 13*b*, 15*b* of the top and bottom platens 12, 14 accept the load and transfer it to both the top and bottom platens 12, 14 and, potentially, to the support spacer 16 if the support spacer 16 is in contact with or connected to the side panels. The lateral load is transferred to adjacent storm water drain tank modules 10 and their top and bottom platens 12, 14 and, eventually, into the surrounding soil within which the storm water drain tank modules 10 are buried. The support spacer 16 assists in maintaining the spacing between the top and bottom platens 12, 14 and alignment of the adjacent top and bottom platens 12, 14 is preferably maintained by engagement of the slots 20 and tabs 18.

In the assembled configuration, lateral loads may be substantially transferred directly across top the and bottom platens 12, 14, respectively, of the adjacent storm water drain tank modules 10. For the lateral compression load transferred to the support spacer 16, the top and bottom platens 12, 14 receive the load at column sockets 28 into which the columns 16 are installed in both the top and bottom platens 12, 14 in the preferred embodiment, so that the lateral compressive load is preferably resisted through the compression of the top and bottom platens 12, 14 (neglecting frictional forces). Vertical alignment of adjacent top platens 12 and bottom platens 14 or alignment of the mating top and bottom platen peripheral edges 13*b*, 15*b* is preferred for the storm tank to properly resist compressive lateral loading. The top and bottom platens 12, 14 preferably include a plurality of the column sockets 28 defined and opening at the bottom surface 13*c*. The plurality of columns 16*a*, 16*b*, 16*c*, 16*d*, 16*e*, 16*f*, 16*g*, 16*h* are attached to adjoining ones of the plurality of sockets 28 to space the top and bottom platens 12, 14 relative to each other. Ends of the columns 16*a*, 16*b*, 16*c*, 16*d*, 16*e*, 16*f*, 16*g*, 16*h* are positioned in the column sockets 28 to separate and top and bottom platens 12, 14, preferably positioning the top platen 12 in a relatively parallel orientation relative to the bottom platen 14 in the assembled configuration. As was described above, the preferred storm water drain tank modules 10 are not limited to including the eight (8) columns 16*a*, 16*b*, 16*c*, 16*d*, 16*e*, 16*f*, 16*g*, 16*h* of the preferred embodiment and may include other structures that space the top and bottom platens 12, 14 and provide space between the top and bottom platens 12, 14 for storage of fluid and other materials, preferably storm water.

In the preferred embodiment, the top and bottom platens 12, 14 include at least three (3) support beams 36 extending therefrom to adjacent column sockets 28. For example, each of the corner column sockets 28 includes a support beam 36 extending to an adjacent corner socket 28 generally in a direction parallel to the lateral axis 24, a support beam 36 extending to an adjacent middle socket 28 generally in a direction parallel to the longitudinal axis 22 and a support beam 36 extending to a diagonal middle socket 28 generally extending at an acute angle relative to the longitudinal and lateral axes 22, 28. The support beams 36 provide direct load paths for transferring loads from, to and between the columns 16*a*, 16*b*, 16*c*, 16*d*, 16*e*, 16*f*, 16*g*, 16*h* or into the columns 16*a*, 16*b*, 16*c*, 16*d*, 16*e*, 16*f*, 16*g*, 16*h* from the platens 12, 14 and the soil within which the storm tank is buried. The support beams 36 also resist lateral compression from loads applied to the platens 12, 14 from the columns 16*a*, 16*b*, 16*c*, 16*d*, 16*e*, 16*f*, 16*g*, 16*h*, the optional side panels and other storm water drain tank modules 10 in the assembly. The platens 12, 14 are not limited to including the support beams 36, but the support beams 36 are preferred for load transfer and stiffness and rigidity of the platens 12, 14 and the storm water drain tank modules 10.

Some installations of the storm water drain tank modules 10 include multiple vertical layers of storm water drain tank modules 10 with the storm water drain tank modules 10 stacked on each other, generally in rows of assembled storm water drain tank modules 10. To limit lateral motion of an upper assembly, row or layer of the storm water drain tank modules 10 relative to a lower assembly, row or layer of storm water drain tank modules 10, alignment pins 30 are placed in pin holes 32. The pin holes 32 of the bottom platens 14 of the upper assembly, row or layer of storm water drain tank modules 10 and the pin holes 32 of the top platen 12 of the lower assembly, row or layer of storm water drain tank modules 10 are aligned and the alignment pins 30 are positioned in the aligned pin holes 32. As a non-limiting example and referring to FIGS. 9-11, a first top platen 12*a* of the first module 10*a* is shown positioned relative to a fifth bottom platen 14*d* of a fifth module 10*e*, which is aligned and stacked onto the first module 10*a*. In this configuration, the top platen peripheral edge 13*b* of the first top platen 12*a* is aligned with the bottom platen peripheral edge 15*b* of the fifth bottom platen 14*d*. The pin holes 32 of the first top platen 12*a* and the fifth bottom platen 14*d* are aligned parallel to the vertical axis 26 and the alignment pin 30 is inserted into the pin holes 32 to laterally secure the first top platen 12*a* relative to the fifth bottom platen 14*e* and the first module 10*a* relative to the fifth module 10*e*. The alignment pins 30 positioned in the pin holes 32 also provide continuity in load transfer from column 16*a*, 16*b*, 16*c*, 16*d*, 16*e*, 16*f*, 16*g*, 16*h* to column 16*a*, 16*b*, 16*c*, 16*d*, 16*e*, 16*f*, 16*g*, 16*h* in a stacked configuration.

The tabs and slots 18, 20 are preferably incorporated into each of the top and bottom platens 12, 14 along the peripheral edges 13*b*, 15*b* of the top and bottom platens 12, 14 or around the perimeter of the top and bottom platens 12, 14. During installation, the tabs 18 on each platen 12, 14 nest into the slots 20 on adjacent platens 12, 14, thereby aligning the platens 12, 14 laterally relatively to each other or along the longitudinal and lateral axes 22, 24, respectively. The tabs 18 and slots 20 have a generally trapezoid shape extending from or into, respectively, the peripheral edges 13*b*, 15*b* of the platens 12, 14 and are preferably angled at approximately forty-five degrees (45°) relative to the longitudinal and lateral axes 22, 24, respectively, thereby allowing the tabs 18 on front, rear and side peripheral edges 13*b*, 15*b* of the adjacent platens 12, 14 to be aligned simultaneously in one angled motion (see FIGS. 5-7).

Figure 7B:
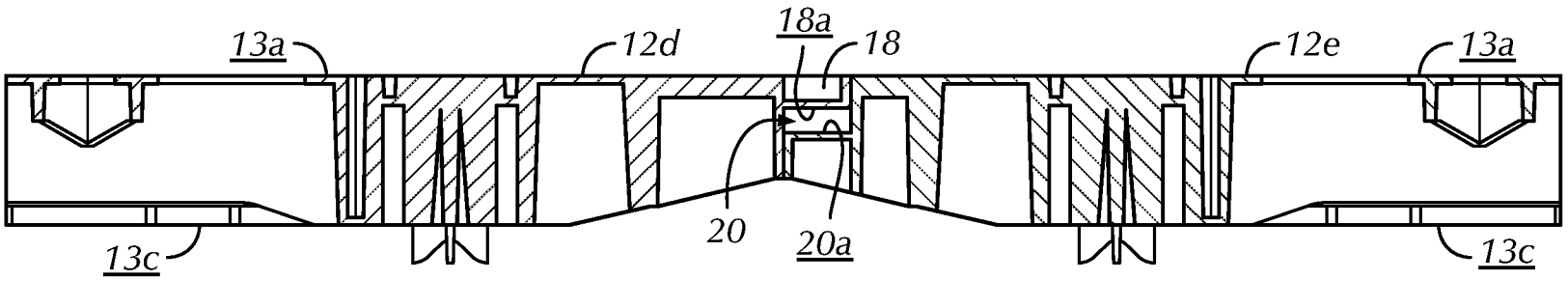
FIG. 7B is a cross-sectional view of top platens of third and fourth storm water drain tank modules of the assembly of FIG. 7, taken along line 7B-7B of FIG. 7.

Once aligned, the engaged slots 20 and tabs 18 resist excessive vertical misalignment between adjacent platens 12, 14 through contact between bottom faces 18*a* of the tabs 18 and top faces 20*a* of slots 20 on the adjacent platens 12, 14 (see FIG. 7B). Since proper vertical alignment of adjacent top and bottom platens 12, 14 is preferred for the assembled storm tank to resist compressive lateral loading and generally for efficient load transfer in the assembly, the addition of the tabs 18 and slots 20 is beneficial for the assembled storm tank and the assembled storm water drain tank modules 10 by improving the reliability of the storm tank when subjected to lateral loading. In addition, the engagement of the slots 20 and tabs 18 align the support beams 18 of adjacent platens 12, 14 and the peripheral edges 13*b*, 15*b*, as well as limiting vertical misalignment between adjacent top and bottom platens 12, 14 to limit movement of the platens 12, 14 past each other in the vertical direction in the assembled configuration. The engaged slots 20 and tabs 18 also align the peripheral edges 13*b*, 15*b* to transfer lateral load and maintain continuity across the storm water drain tank modules 10 in the assembled configuration to take advantage of the platens 12, 14 so they efficiently resist lateral compression. The generally V-shape or polygonal-shape of the tabs 18 and slots 20, with a mouth 23*a* at the peripheral edges 13*b*, 14*b* of the slots 20 being open, facilitate insertion or sliding of the tabs 18 into the slots 20, which is particularly desirable for assembly of the fourth module 10*d* into the first, second and third modules 10*a*, 10*b*, 10*c* in the assembled configuration (FIGS. 5-7). The generally V-shape or polygonal-shape of the tabs 18 and slots 20, when nested, align the peripheral edges 13*b*, 15*b* of the adjacent platens 12, 14. The tabs 18 are preferably slidable into or engageable with the slots 20 by moving the tabs 18 laterally into the slots 20 through the opening between the legs 21*a*, 21*b* of the slots 20, as opposed to vertical sliding, which is difficult for alignment purposes.

Figure 8B:
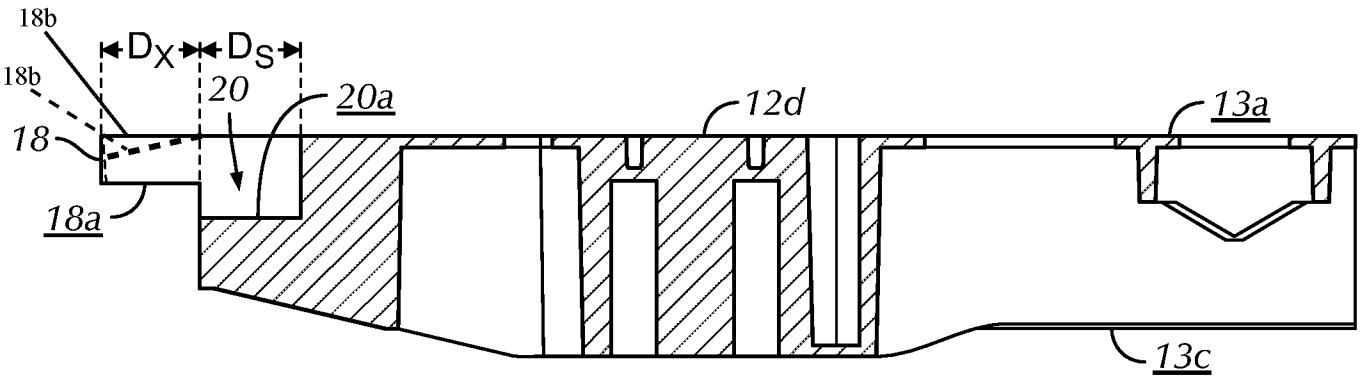
FIG. 8B is a cross-sectional view of a top platen of the fourth storm water drain tank module of FIG. 5, taken along line 8C-8C of FIG. 8.
Figure 8:
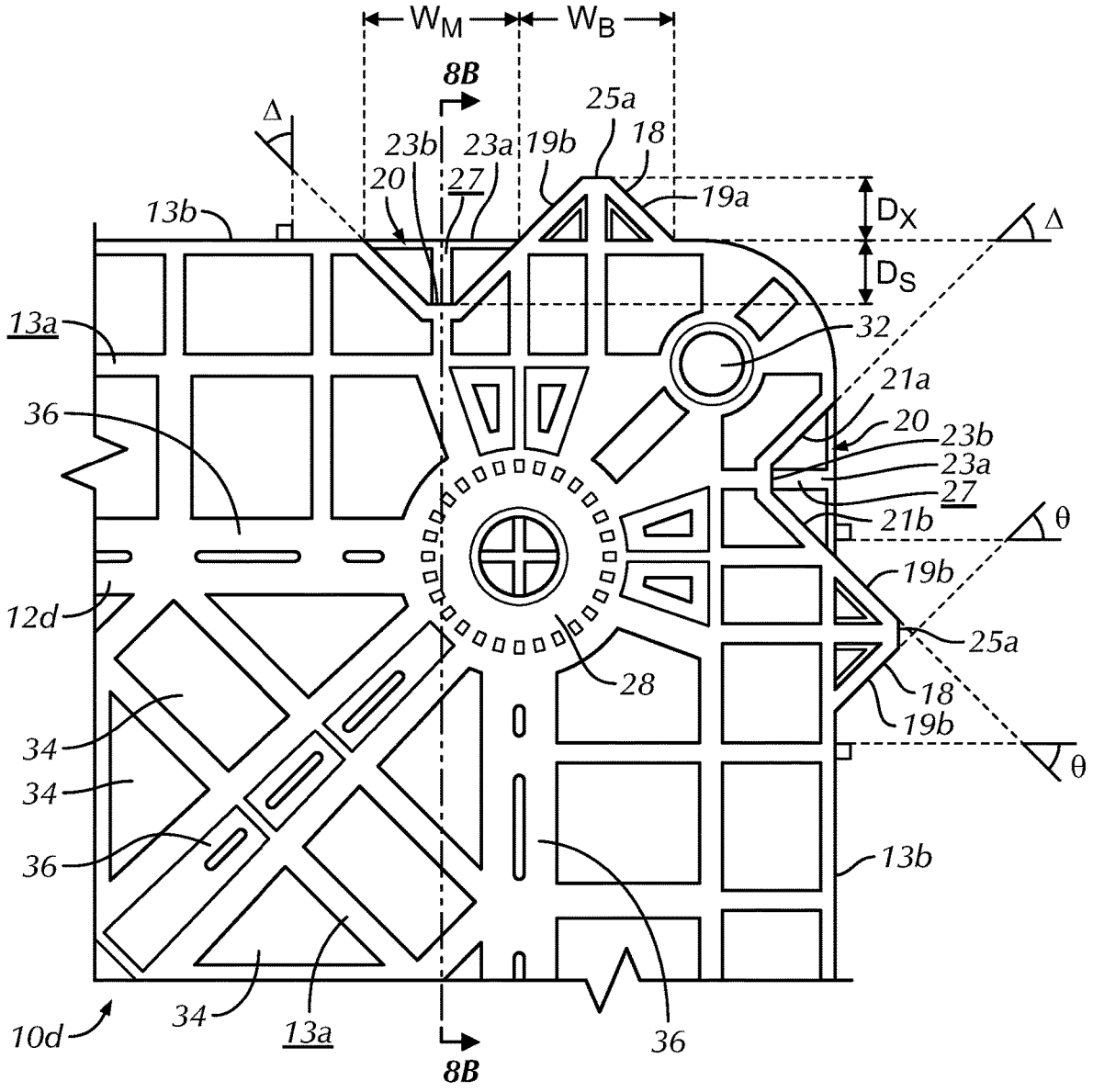
FIG. 8 is a top plan view of the corner of the fourth storm water drain tank module of FIG. 5.

Referring to FIGS. 7-8B, a space or gap is defined between the bottom faces 18*a* of the tabs 18 and the top faces 20*a* of the slots 20 in the assembled configuration (FIG. 7B). The gap facilitates assembly of the modules 10 into the storm tank, provides tolerance for the assembly and provides space for displacement of foreign objects out of the way of the tabs 18 when inserted into the slots 20. The environments where the storm tanks, which are comprised of pluralities of the modules 10, are assembled can be dusty and dirty and subject to encroachment of foreign objects, such as rocks and soil, onto the modules during assembly. The space or gap between the bottom faces 18*a* of the tabs 18 and the top faces 20*a* of the slots 20 provides space for urging these foreign objects out of the way of the tabs 18 during insertion and assembly of the tabs 18 into the slots 20. The slots 20 also preferably have windows through the bottom surfaces 27 that open into an inner space of the modules 10 between the top and bottom platens 12, 14 where rocks, mud, soil and dirt may be urged out of the way of the tabs 18 during assembly. The tabs 18 also include top faces 18*b* that is substantially coplanar with the upper surface 13*a* in the preferred embodiment, but may also taper from a larger thickness to a smaller thickness at the tip 25*a* in an alternative preferred embodiment, shown in dashed linetype in FIG. 8B. The alternative preferred taper of the top faces 18*b* provides relief for assembly of the modules 10 and facilitates movement or space for foreign objects that may impede assembly.

Figure 9:
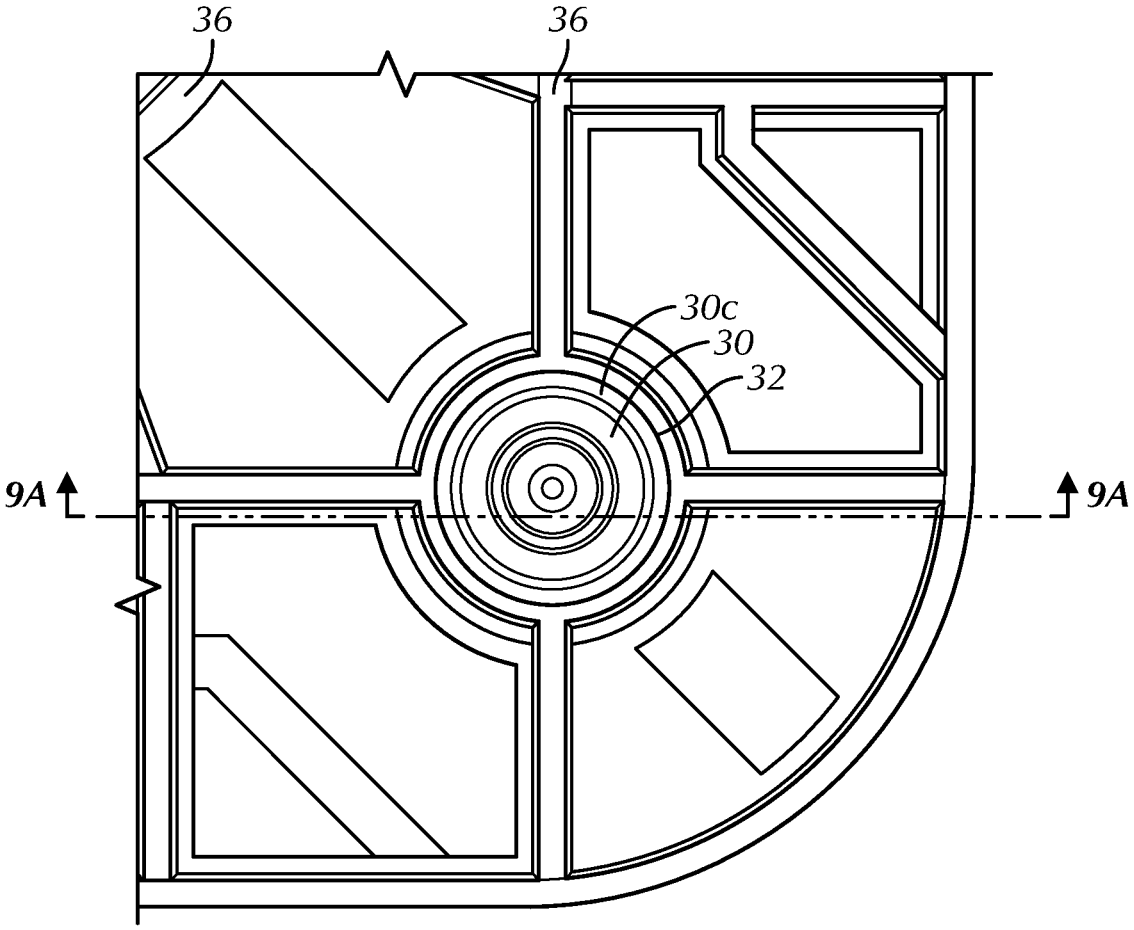
FIG. 9 is a magnified top plan view of a portion of a top platen of a first storm water drain tank module of FIG. 5, a bottom platen of a fifth storm water drain tank module positioned on top of the top platen of the first storm water drain tank module and an alignment pin, taken from within shape 9 of FIG. 5.
Figure 11:
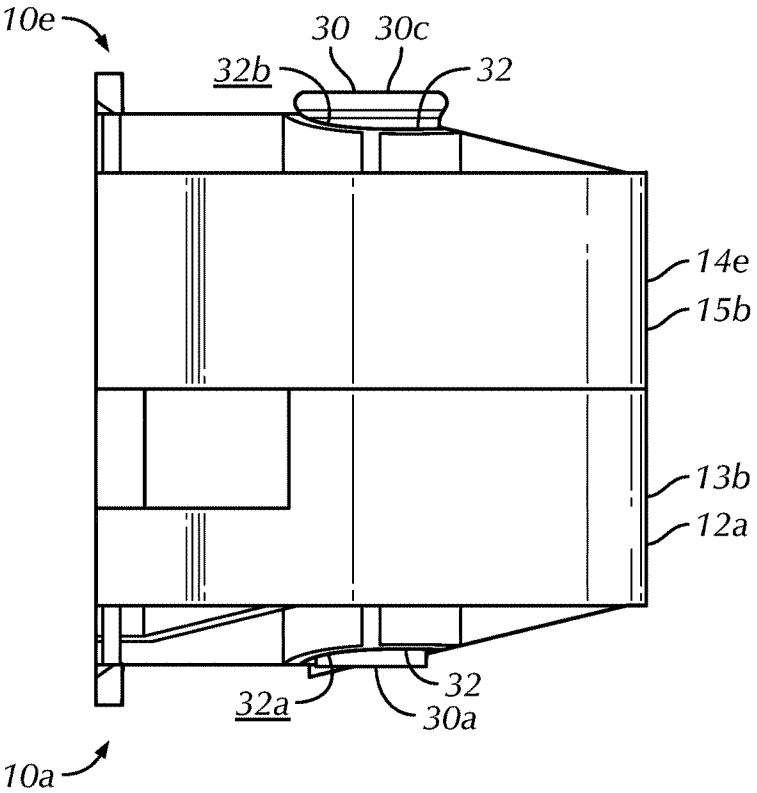
FIG. 11 is a side elevational view of the portion of the top platen and the bottom platen of FIG. 10, wherein the alignment pin is installed in pin holes of the top and bottom platens.
Figure 10:
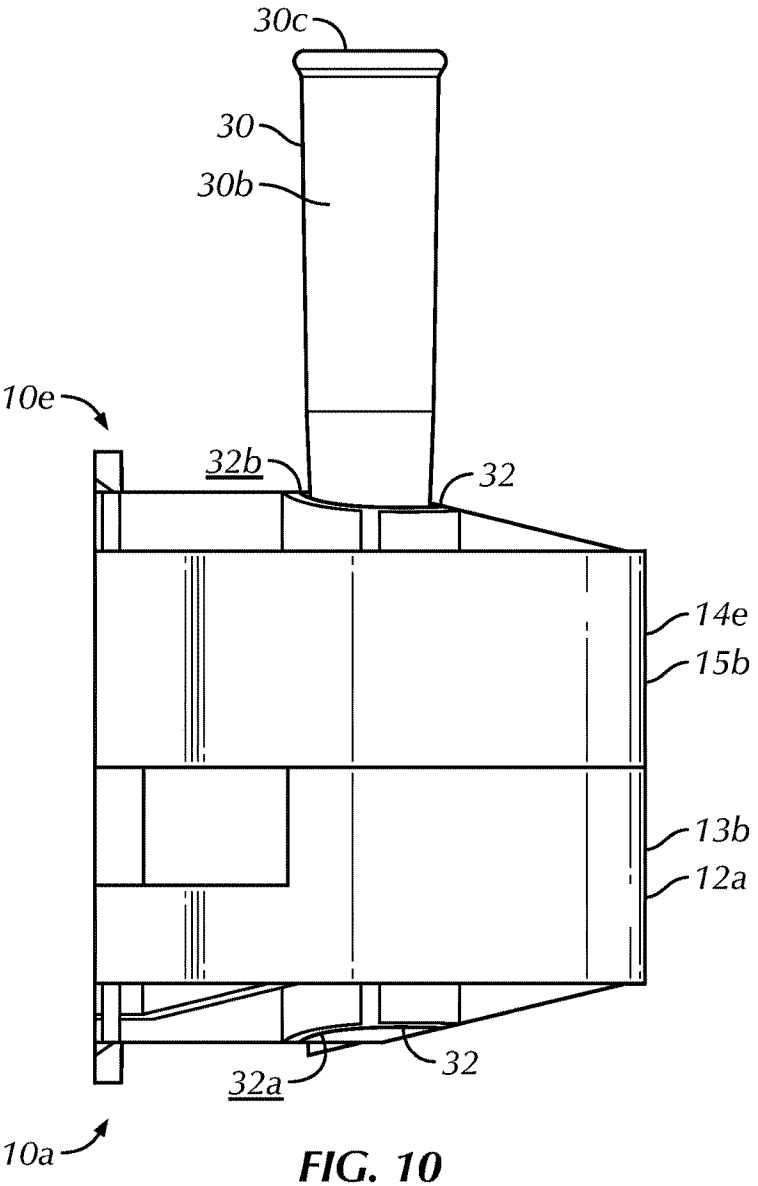
FIG. 10 is a side elevational view of the portion of the top platen of the first storm water drain tank module of FIG. 9, the bottom platen of the upper storm water drain tank module of FIG. 9 and the alignment pin, wherein the alignment pin is positioned for insertion into assembly holes of the top and bottom platens.

Referring to FIGS. 1-11, for installations that include the upper and lower layers of storm water drain tank modules 10, stacking features are incorporated into the platens 12, 14 to limit the relative lateral motion or movement along the longitudinal and lateral axes 22, 24 of vertically stacked storm water drain tank modules 10, such as the first module 10*a* and the fifth module 10*e* (FIGS. 9-11), relative to each other. Specifically, the top and bottom platens 12, 14 include the pin holes 32 that are preferably positioned proximate each of the four (4) corners of the top and bottom platens 12, 14 and the alignment pin 30. The pin holes 32 on the platens 12, 14 are preferably enclosed by a cylindrical face 32*a* and are spaced so that the pin holes on the bottom platen 14 align with the pin holes 32 in the top platen 12 in the assembled configuration, such as the alignment of the pin hole 32 in the top platen 12*a* of the first module 10*a* and the pin hole 32 in the bottom platen 14*e* of the fifth module 10*e*, which is shown in FIGS. 9-11. Once the pin holes 32 are aligned, the alignment pin 30 is placed or dropped into the holes 32, limiting relative lateral movement or movement along the longitudinal and lateral axes 22, 24 of the storm water drain tank modules 10, 10*a*, 10*e* relative to each other and aligning the platens 12, 14 and the columns 16*a*, 16*b*, 16*c*, 16*d*, 16*e*, 16*f*, 16*g*, 16*h*. The alignment pins 30 preferably have a tapered configuration from an insertion end 30*a* to a top end 30*b* to facilitate alignment of the alignment pins 30 in the aligned pin holes 32 during installation and assembly. The alignment pins 30 also preferably include a lip 30*c* at the top end 30*b* that is larger than the pin holes 32 to stop the alignment pins 30 from being inserted too far into or through the pin holes 32 and to provide a feature for engagement by a tool for removal of the alignment pins 30 from the pin holes 32. The alignment pins 30 taper from the insertion end 30*a*, which has an insertion diameter Di, to the top end 30*b*, which has a top end diameter DT, wherein the insertion diameter Di is less than the top end diameter DT.

Figure 9A:
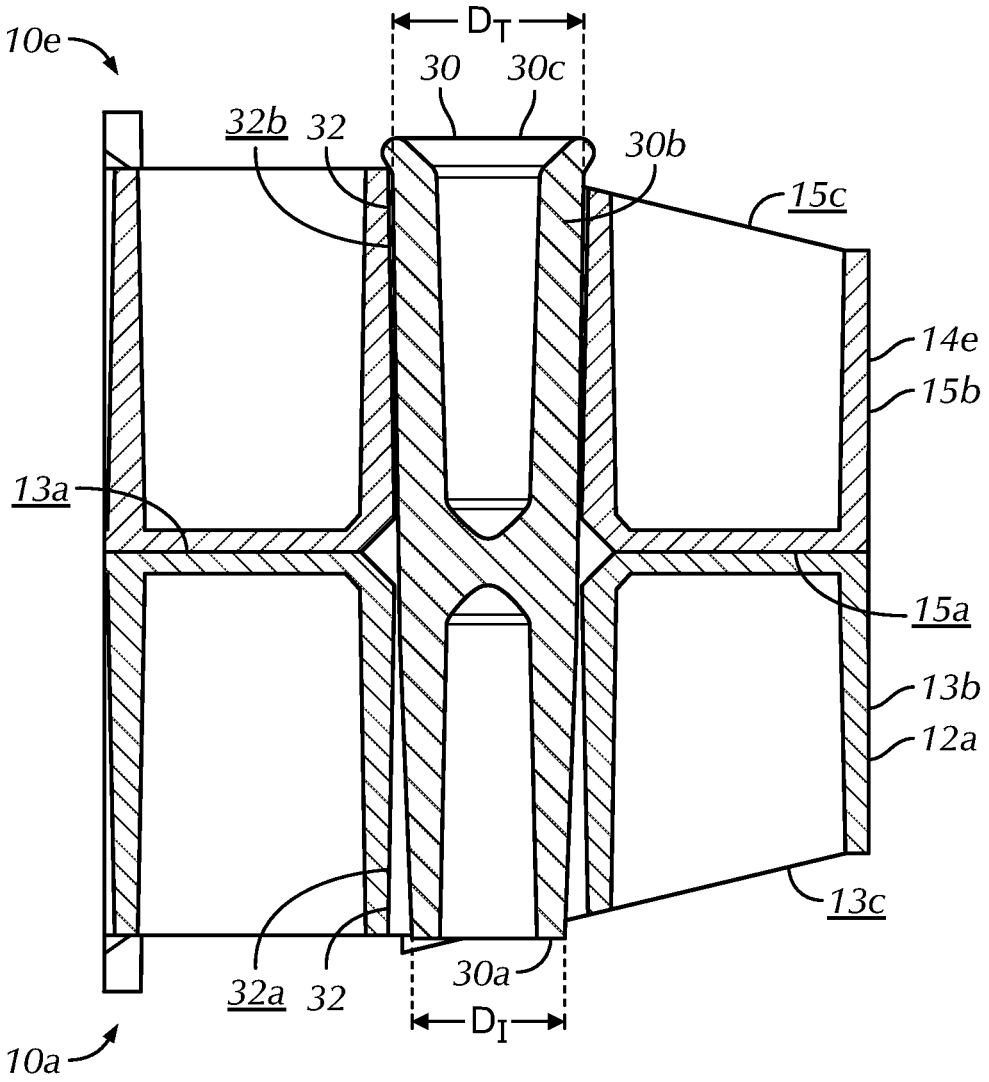
FIG. 9A is a cross-sectional view of the top and bottom platens and alignment pin of FIG. 9, taken along line 9A-9A of FIG. 9.

Certain prior stacking feature designs for existing storm tank modules required placement of alignment pins in the top platen of the first layer of modules before adding a second layer of assembled modules by placing the second modules on top of the first modules with a downward motion to engage the pins. Since the tabs 18 and slots 20 of the preferred top and bottom platens 12, 14 may be interlocked through a lateral sliding motion (see FIGS. 5-7) and are preferably not assembled using a downward or vertical motion, because the tabs 18 would interfere with peripheral edges of the adjacent top or bottom platens 12, 14, the alignment pins 30 and pin holes 32 enable installation of the alignment pins 30 after the tabs 18 are aligned in the slots 20 in the assembled configuration. Additionally, since the lip 30*c* on the top end 30*b* of each alignment pin 30 prevents the pin 30 from falling fully through the pin hole 32, the pins 30 may either be inserted into the bottom platen 14 of the upper layer of storm water drain tank modules 10 in a stacked configuration prior to performing the sliding action to interlock the tabs 18 and slots 20 or after the alignment has already occurred. For example, the alignment pins 30 may be partially inserted into each of the four (4) pin holes 32 in the fifth bottom platen 14*e* of the fifth module 10*e*, the fifth module 10*e* may be arranged such that its tabs 18 and slots 20 engage adjacent storm water drain tank modules 10 on the upper layer of storm water drain tank modules 10 and the partially inserted alignment pins 30 may be urged downwardly into the aligned pin holes 32 of the first top platen 12*a* of the first module 10*e* until the lip 30*c* is positioned adjacent rims 32*b* of the pin holes 32 of the fifth bottom platen 14*e*. When the lip 30*c* is engaged with or near an upward surface 15*c* of the fifth module 10*e*, the insertion end 30*a* is preferably positioned adjacent a lower surface 13*c* of the first module 10*a*, as is shown in FIG. 9A, but is not so limited and may be otherwise sized and configured, as long as the pin 30 laterally supports the engaged modules 10*a*, 10*e*.

In the preferred embodiment, aligning of the planes of adjacent top and bottom platens 12, 14 is preferred to resist lateral compression from soil on the side panels in contact with the walls of the excavation in a buried condition. Other prior art box structures that have intermediate walls suffer from misalignment between upper and lower surfaces of adjacent boxes or lateral compression displacement varies between layers causing misalignment vertically. The difference is that if the box structures include intermediate walls, the adjacent intermediate walls are point loaded by the misaligned horizontal plane. Since the walls are designed for interface with the soil, the misalignment generates a point load on the mid vertical span of the side panels and failure may occur. The load is still translated to the top and bottom planes in a box structure to resist soil pressures across an installation through horizontal planes.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the present disclosure.

We claim:

1. A storm water drain tank module for assembly into a storm tank for storage of storm water, the tank module comprising:

a top platen having an upper surface and a top platen peripheral edge;

a bottom platen having a bottom surface and a bottom platen peripheral edge;

a support spacer attached to the top and bottom platens to space the top platen relative to the bottom platen; and a plurality of tabs and a plurality of slots defined proximate the top and bottom platen peripheral edges, respectively, each of the plurality of tabs extending outwardly away from the top and bottom platen peripheral edges, respectively and each of the plurality of slots extending into the top and bottom platen peripheral edges, the plurality of slots defining slot mouths and slot bottom surfaces, each of the plurality of slots being open in a lateral direction at the slot mouths, the plurality of tabs and the slot bottom surfaces of the plurality of slots configured to maintain alignment and vertical positioning between the module and an adjacent module.

2. The storm water drain tank module of claim 1, wherein each of the slot mouths defines a slot width proximate the top and bottom platen peripheral edges, respectively, the plurality of slots tapering inwardly toward butt ends, respectively, such that the slot width is greater than a width of any other portion of the plurality of slots.

3. The storm water drain tank module of claim 1, wherein each of the plurality of tabs has a substantially trapezoid shape.

4. The storm water drain tank module of claim 3, wherein each of the plurality of tabs includes a pair of tab legs, the pair of tab legs extending outwardly from the top and bottom platen peripheral edges proximate one of the upper and lower surfaces at a tab angle.

5. The storm water drain tank module of claim 4, wherein the tab angle is approximately forty-five degrees (45°).

6. The storm water drain tank module of claim 1, wherein each of the plurality of slots has a substantially trapezoid shape.

7. The storm water drain tank module of claim 6, wherein each of the plurality of slots includes a pair of slot legs, the pair of slot legs extending inwardly from the top and bottom platen peripheral edges proximate one of the top and bottom surfaces at a slot angle.

8. The storm water drain tank module of claim 7, wherein the slot angle is approximately forty-five degrees (45°).

9. The storm water drain tank module of claim 1, wherein each of the plurality of slots has a substantially triangular shape and each of the plurality of tabs has a substantially triangular shape.

10. The storm water drain tank module of claim 1, wherein the plurality of tabs includes at least eight tabs and the plurality of slots includes at least eight slots.

11. The storm water drain tank module of claim 10, wherein the plurality of tabs includes twelve tabs and the plurality of slots includes twelve slots.

12. The storm water drain tank module of claim 1, wherein the plurality of tabs and the plurality of slots includes a first tab and a first slot, the first tab positioned adjacent the first slot, the first tab integrally formed with one of the top platen and the bottom platen.

13. The storm water drain tank module of claim 1, wherein the support spacer is comprised of a plurality of columns, the top and bottom platens include a plurality of column sockets, adjoining ones of the plurality of column sockets configured to accept opposing ends of the plurality of columns to attach the plurality of columns to the top and bottom platens, the top platen and the bottom platen being constructed of a polypropylene material.

14. The storm water drain tank module of claim 13, wherein the plurality of columns includes at least four columns.

15. The storm water drain tank module of claim 14, wherein the plurality of columns includes eight columns.

16. The storm water drain tank module of claim 1, wherein the support spacer is constructed of a polyvinyl chloride material.

17. A storm water drain tank module assembly for storage of storm water runoff, the storm water tank assembly comprising:

a first module including a first top platen, a first bottom platen and a first support spacer, a first plurality of tabs extending laterally outwardly from one of the first top platen, the first bottom platen and the first support spacer and a first plurality of slots extending laterally inwardly into one of the first top platen, the first bottom platen and the first support spacer, the first plurality of tabs including a first tab and the first plurality of slots including a first slot defining a first slot mouth; and a second module including a second top platen, a second bottom platen and a second support spacer, a second plurality of tabs extending laterally outwardly from one of the second top platen, the second bottom platen and the second support spacer and a second plurality of slots extending laterally inwardly into one of the second top platen, the second bottom platen and the second support spacer, the second plurality of tabs including a second tab and the second plurality of slots including a second slot, the first tab positioned in the second slot and the second tab positioned in the first slot in an assembled configuration, the first and second modules configured such that the second tab is engageable with the first slot in the assembled configuration by moving the second tab laterally through the first slot mouth into the first slot.

18. The storm water drain tank module assembly of claim 17, wherein the first tab and first slot are positioned adjacent to each other and the second tab and second slot are positioned adjacent to each other.

19. The storm water drain tank module assembly of claim 17, further comprising:

a third module including a third bottom platen, the third bottom platen including a third peripheral edge and a second pin hole, the third bottom platen defining a third bottom surface, the first top platen including a first pin hole, the first top platen defining a first top surface, the first top platen surface positioned adjacent the third bottom surface and the first pin hole aligned with the second pin hole in the assembled configuration.

20. The storm water drain tank module assembly of claim 19, further comprising:

an alignment pin including an insertion end, a top end and a lip positioned at the top end, the alignment pin tapering from an insertion end diameter at the insertion end to a top end diameter at the top end, the insertion end diameter being smaller than the top end diameter, the alignment pin positioned in the first and second pin holes in the assembled configuration.

21. The storm water drain tank module assembly of claim 20, wherein the second pin hole includes a rim opposite the bottom surface, the lip positioned adjacent the rim in the assembled configuration.

22. The storm water drain tank module assembly of claim 17, wherein the first plurality of tabs is comprised of twelve tabs and the first plurality of slots is comprised of twelve slots.

23. The storm water drain tank module assembly of claim 17, wherein the first top platen includes a first peripheral edge and the second top platen includes a second peripheral edge, the first peripheral edge is position adjacent the second peripheral edge in the assembled configuration, the first plurality of tabs and the first plurality of slots positioned at the first peripheral edge, the second plurality of tabs and the second plurality of slots positioned at the second peripheral edge.

24. The storm water drain tank module assembly of claim 17, further comprising:

an alignment pin including an insertion end and a top end, the alignment pin tapering from an insertion end diameter at the insertion end to a top end diameter at the top end, the insertion end diameter being smaller than the top end diameter, the alignment pin connecting the first module to the second module in the assembled configuration.

* * * * *